US011660488B2

(12) United States Patent
d'Anconia et al.

(10) Patent No.: US 11,660,488 B2
(45) Date of Patent: May 30, 2023

(54) SPRING EXERCISE SYSTEM AND METHOD OF EXERCISING

(71) Applicants: Charlyn Huss d'Anconia, Los Angeles, CA (US); Joel Raymond Fernandez, Los Angeles, CA (US)

(72) Inventors: Charlyn Huss d'Anconia, Los Angeles, CA (US); Joel Raymond Fernandez, Los Angeles, CA (US)

( * ) Notice: Subject to any disclaimer, the term of this patent is extended or adjusted under 35 U.S.C. 154(b) by 151 days.

(21) Appl. No.: 17/174,312

(22) Filed: Feb. 11, 2021

(65) Prior Publication Data

US 2022/0249895 A1 Aug. 11, 2022

(51) Int. Cl.
*A63B 21/00* (2006.01)

(52) U.S. Cl.
CPC .... *A63B 21/00043* (2013.01); *A63B 21/4034* (2015.10); *A63B 21/4035* (2015.10)

(58) Field of Classification Search
CPC . A63B 21/00043; A63B 21/02; A63B 21/023; A63B 21/025; A63B 21/04; A63B 21/055; A63B 21/0552; A63B 21/0555; A63B 21/0557; A63B 21/28; A63B 21/285; A63B 21/4011; A63B 21/4013; A63B 21/4015; A63B 21/4017; A63B 21/4019; A63B 21/4021; A63B 21/4033; A63B 21/4034; A63B 21/4035; A63B 21/4039; A63B 21/4043; A63B 69/0057; A63B 69/0059; A63B 69/0062; A63B 2209/00

See application file for complete search history.

(56) References Cited

U.S. PATENT DOCUMENTS 61,702 A * 2/1867 Barnett ..... A63B 21/0552 482/125
841,227 A * 1/1907 Chellis ..... A63B 21/0552 267/74
1,023,756 A * 4/1912 Pons ..... A63B 21/00043 482/126
1,075,309 A * 10/1913 Sullivan ..... A63B 21/0552 601/36
1,307,905 A * 6/1919 Hendrickson ..... A63B 21/0552 482/129

(Continued)

FOREIGN PATENT DOCUMENTS

KR 20130049488 A * 5/2013 ..... A63B 21/0552

*Primary Examiner* — Gary D Urbiel Goldner
(74) *Attorney, Agent, or Firm* — Fei Hung Yang

(57) ABSTRACT

A spring exercise system and method of exercising that allows a user to perform a full body, low-impact style of exercise. The system utilizes a non-fixed extension spring that stretches and generates resistance when pulling and pressing forces are applied. The extension spring or springs are stretchable between multiple types of interchangeable grasp handles which may include any combination of a resilient loop handle with or without double "D" rings, a single rigid handle, and/or a resilient double loop handle. The spring may have a swiveling link or other mechanism/structure that joins the free ends of the spring to the grasp handles allowing a 360° rotation. The grasp handles are used with combinations of hands and feet, arms and legs to generate an extension of resistance that stretches, strengthens and tones muscles, enhances flexibility, core strength, joint stability, and muscle balance.

15 Claims, 37 Drawing Sheets

(56) References Cited

U.S. PATENT DOCUMENTS 1,759,719 A * 5/1930 Spino ..... F16F 1/125 267/74
1,950,174 A * 3/1934 Harrison ..... A63B 21/04 482/130
1,980,861 A * 11/1934 Hunter ..... A63B 21/023 482/125
2,498,006 A * 2/1950 Ridill ..... A63B 21/4021 482/125
2,919,134 A * 12/1959 Zuro ..... A63B 21/04 248/200.1
3,215,429 A * 11/1965 Shaboo ..... A63B 21/4007 482/125
3,451,675 A * 6/1969 Burzenski ..... A63B 21/045 482/126
3,559,988 A * 2/1971 Greenless ..... A63B 21/045 482/44
3,589,721 A * 6/1971 Cronauer ..... A63B 21/0552 482/125
4,489,937 A * 12/1984 Kong ..... A63B 21/00043 482/126
4,591,150 A * 5/1986 Mosher ..... A63B 21/1663 482/125
4,634,114 A * 1/1987 Garcia ..... A63B 23/16 482/122
4,681,317 A * 7/1987 Brandell ..... A63B 21/0552 482/126
4,729,345 A * 3/1988 Anderson ..... A01K 27/003 119/770
4,756,527 A * 7/1988 Ledbetter ..... A63B 21/4017 482/139
4,815,731 A * 3/1989 Suarez ..... A63B 21/055 482/126
4,856,776 A * 8/1989 Ching-Liang ..... A63B 21/045 482/122
4,865,316 A * 9/1989 Yeaman ..... A63B 21/00043 482/126
4,909,506 A * 3/1990 Smith ..... A63B 21/4011 482/126
4,913,417 A * 4/1990 Francu ..... A63B 21/05 482/45
5,046,727 A * 9/1991 Wilkinson ..... A63B 21/015 428/909
5,161,486 A * 11/1992 Brown ..... A01K 27/00 119/776
D337,395 S * 7/1993 Erlinger ..... A63B 21/00043 D30/153
5,224,913 A * 7/1993 Rodibaugh ..... A63B 21/4025 482/126
5,497,733 A * 3/1996 Hull ..... A01K 27/003 119/793
5,569,137 A * 10/1996 Uen ..... A63B 21/0552 482/121
5,682,840 A * 11/1997 McFarland ..... A01K 27/002 119/856
5,885,196 A * 3/1999 Gvoich ..... A63B 21/00185 482/125
5,941,799 A * 8/1999 Bergdorf ..... A63B 21/0455 482/44
6,390,959 B1 * 5/2002 Tornabene ..... A63B 21/00043 482/125
7,674,209 B2 * 3/2010 Greene ..... A63B 21/02 482/121
7,766,805 B1 * 8/2010 Horne ..... A63B 23/1281 482/121
7,779,789 B2 * 8/2010 Tanaya ..... A01K 27/003 119/770
D664,611 S * 7/2012 Pinskiy ..... A63B 21/045 D21/662
D664,612 S * 7/2012 Pinskiy ..... A63B 21/045 D21/662
9,421,683 B2 * 8/2016 Savarino ..... A63B 21/023
9,468,802 B2 * 10/2016 Gutierrez ..... A63B 23/03541
9,914,010 B2 * 3/2018 Gutierrez ..... A63B 21/4035
10,220,237 B2 * 3/2019 Bentley ..... A63B 21/4035
10,625,109 B1 * 4/2020 Bytella ..... A63B 21/0023
11,167,173 B2 * 11/2021 Cone ..... A63B 23/0488
D956,892 S * 7/2022 d'Anconia ..... A63B 21/00043 D21/693
2002/0160890 A1 * 10/2002 Fazio ..... A63B 21/00072 482/112
2003/0134726 A1 * 7/2003 Yu ..... A63B 21/00043 482/110
2004/0132592 A1 * 7/2004 Yu ..... A63B 21/4035 482/126
2004/0180766 A1 * 9/2004 Guinn ..... A63B 21/4045 482/126
2005/0085350 A1 * 4/2005 Shen ..... A63B 23/00 482/91
2005/0085355 A1 * 4/2005 Berard ..... A63B 21/0552 482/126
2005/0085356 A1 * 4/2005 Berard ..... A63B 21/0552 482/126
2005/0233877 A1 * 10/2005 Lin ..... A63B 21/026 482/121
2006/0211551 A1 * 9/2006 Mandell ..... A63B 21/4035 482/121
2009/0017931 A1 * 1/2009 Kurisu ..... A63B 69/3623 473/238
2009/0215595 A1 * 8/2009 Alessandri ..... A63B 21/4017 482/139
2010/0069207 A1 * 3/2010 Ko ..... A63B 21/00043 482/126
2012/0329618 A1 * 12/2012 White ..... A63B 21/0552 482/126
2013/0217547 A1 * 8/2013 Hinds ..... A63B 21/4035 482/96
2013/0316882 A1 * 11/2013 Param ..... A63B 21/055 482/125
2014/0073496 A1 * 3/2014 Bannerman ..... A63B 21/0552 482/139
2018/0185692 A1 * 7/2018 Wailes ..... A61H 1/02
2018/0200558 A1 * 7/2018 Alnajjar ..... A63B 23/12
2019/0015696 A1 * 1/2019 Porterfield ..... A63B 21/4049

* cited by examiner

SPRING EXERCISE SYSTEM AND METHOD OF EXERCISING

CROSS REFERENCE OF RELATED APPLICATIONS

This application claims the benefits of U.S. provisional application No. 62/976,180, filed Feb. 13, 2020 and entitled SPRING EXERCISE APPARATUS AND TECHNIQUES FOR USING SAME, which provisional application is incorporated by reference herein in its entirety.

FIELD OF THE INVENTION

The present invention relates generally to a spring exercise apparatus and method that can be applied across multiple exercise systems including but not limited to Pilates, yoga, ballet, barre, and multiple exercise and Pilates apparatus. Moreover, the present invention relates to a spring exercise apparatus and method that can be applied across multiple exercise systems including but not limited to Pilates, yoga, ballet, barre, in the water and multiple exercise and Pilates apparatus. It is a low-impact system of exercise that utilizes a non-fixed spring, or springs with multiple resistance levels that extends, and is stretchable between multiple types of interchangeable grasp handles that are graspable and loops that can encircle or wrap around with different combinations of the arms, legs, hands and feet. Whereby the spring generates an extension of resistance that strengthens all muscle groups, enhances flexibility, stabilizes and strengthens the joints, while enhancing mobility and range of motion, emphasizing proper postural alignment, core strength, and muscle balance. The spring exercise system can be used for any low-impact exercise system including but not limited to those referenced above.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, Pilates is a method of exercise that consists of low-impact flexibility and muscular strength and endurance movements. Pilates emphasizes proper postural alignment, core strength and muscle balance. Pilates is named for its creator, Joseph Pilates, who developed the exercises and apparatus in the late $19^{th}$ and early $20^{th}$ centuries. A Pilates routine generally includes exercises and apparatus that promote core strength and stability, muscle control, and endurance, including exercises that stress proper posture and movement patterns and balanced flexibility and strength. It can also be helpful in training for sports or in physical rehabilitation.

Generally, exercise equipment is used for fitness and medical reasons to burn off undesired calories, to improve cardiovascular ability, to tone or strengthen muscles, or to improve flexibility, balance, posture, etc. No matter what the desired end goal of a user of exercise equipment may be, almost all types of exercise equipment aid the user to achieve his or her desired goal by exerting some form of adequate and effective resistance against repeated bodily movements of the user. Often, the exercise devices utilize elastic resistance members such as coil springs. A hook is often used to connect each of the two ends of the coil spring (or generally a force resisting mechanism) between a movable and a fixed location on the exercise equipment.

This is to say that none of the above have incorporated a spring loaded device such as what we are presenting here that can be implemented Hand-to-Hand, Foot-to-Foot, Hand-to-Foot or limb-to limb and as we have explored the applications of this device, now referred to as CoreSpring™, we have discovered that it answers a deep need in the Pilates, fitness and even the rehabilitative communities for spring resistance that is not dependent on and/or limited to or attached to a large, cumbersome apparatus or fixed to a wall, platform or structure of any kind.

It is known in the art that the creation of CoreSpring™ was born out of a need for the use of spring resistance in areas and environments that were not conducive to attaching springs to a fixed structure or apparatus and when the use of the spring was placed in the hands, feet or any combination of the hands and feet with handles, loops or straps made of cloth, leather, fleece or neoprene the immediate activation of crucial, deep, musculoskelatal, postural muscles were identified and enhanced.

This application of the non-fixed or independent spring created a markedly different effect from other so-called props that are employed in Pilates exercises, both on the mat/floor or on the apparatus. Unlike the rubber bands, tubes or balls, hand or ankle weights, or even other Pilates devices such as the Magic Circle™ that employs a spring-like experience with the use of steel bands with pads that enable it to be held by hands, feet or legs, this independent spring is a completely new experience of spring resistance and not just a prop.

Other proposals have involved Pilates exercise techniques and equipment. The problem with these exercises is that the springs are fixed to a machine, they are not independently held by the hands and feet of the user. Also, only one type of grasp handle is used. Even though the above cited Pilates exercise techniques and equipment meets some of the needs of the market, a Spring exercise system and method of exercising that provides a low-impact system of exercise that utilizes a non-fixed spring that extends, and is stretchable between two interchangeable grasp handles or loops that are graspable with different combinations of the hands and feet, arms and legs so as to generate an extension of resistance that strengthens the smaller, deep stabilizing and long muscles, enhances flexibility, stabilizes and strengthens the joints, while enhancing mobility and range of motion, and emphasizes proper postural alignment, core strength, and muscle balance is still desired.

SUMMARY

Illustrative embodiments of the disclosure are generally directed to a spring exercise system and method of exercising which allows a user to perform a low-impact system of exercise that utilizes a non-fixed spring with multiple resistance levels that extends, and is stretchable between multiple interchangeable grasp handles and loops that are graspable with different combinations of the hands, feet, arms, ankles and legs; whereby the spring generates an extension of resistance that strengthens the small and long muscles, enhances flexibility, and emphasizes proper postural alignment, core strength, and muscle balance.

The system utilizes a non-fixed extension spring that stretches when a pulling or pressing force is applied, generating varying levels of resistance, and thereby developing the long muscles, core, and back of the body. The extension spring is stretchable between multiple types of interchangeable grasp handles and loops. The grasp handles may include any combination of a resilient loop handle with double D rings, a single rigid handle, and a resilient double loop handle. The spring may have a swiveling link or other mechanism joining the free ends of the spring to the grasp handles that allows a 360° rotation and facilitating and enabling that the body has a 3-dimensional experience of spring resistance. The grasp handles are able to be grasped with different combinations of the hands and feet, so as to generate an extension of resistance that strengthens the long muscles, enhances flexibility, and emphasizes proper postural alignment, core strength, and muscle balance. In this manner, different styles of exercise are possible, including but not limited to Pilates exercise.

In one non-limiting embodiment, a spring exercise system, comprises a spring defined by a pair of free ends, the spring operable to generate resistance to a pulling or pressing force when stretched.

The system also includes a pair of grasp handles or loops attached to the free ends of the spring, the grasp handles being operable to enable grasping to the hands, the feet, or both, or wrapping the arms, ankles or legs.

The system also may or may not include a swiveling connector joining the free ends of the spring to the grasp loops/handles. The presence or absence of the swiveling connector does not interfere with the grasp handles' ability to rotate up to 360 degrees; whereby the resistance generated by the spring generates an extension of resistance.

In another aspect, the spring comprises an extension spring.

In another aspect, the extension spring comprises an elongated coil spring.

In another aspect, the spring comprises a non-fixed spring.

In another aspect, the extension spring is defined by a soft resistance.

In another aspect, the extension spring is defined by a medium resistance.

In another aspect, the extension spring is defined by a hard resistance.

In another aspect, the spring comprises a metal material or plastic or galvanized plastic.

In another aspect, the grasp handles comprise resilient loop handle.

In another aspect, the grasp handles comprise a single rigid handle.

In another aspect, the grasp handles comprise and a resilient double loop handle.

In another aspect, the grasp handles include at least one of the following materials: leather, fleece, neoprene, and cloth.

In another aspect, the swiveling connector comprises a chain link.

In another aspect, the swiveling connector comprises a metal chain link.

In another aspect, the mechanism joining the free ends of the spring to the grasp handles that allows a 360° movement may not swivel.

In another aspect, the grasp handles are grasped by the hands.

In another aspect, the single resilient loop has double D rings to allow for quick and easy length adjustments.

In another aspect, one grasp handle is grasped by the hand, wrist or arms, and another grasp handle is engaged by the foot, ankle or leg.

In another aspect, the system is operable to perform resistance exercises.

One objective of the present invention is to generate an extension of resistance that strengthens the smaller, deep stabilizing and long muscles, enhances flexibility, stabilizes and strengthens the joints, and emphasizes proper postural alignment, core strength, and muscle balance.

Another objective is to leverage the effects of a non-fixed spring to a Pilates exercise.

Yet another objective is to enable multiple grasp handles to be interchanged on the ends of the spring.

Another objective is to strengthen the long muscles and increase flexibility.

Yet another objective is to provide an exercise system that is operable to perform Pilates and resistance exercises, and across multiple Pilates apparatus and mat repertoire.

Additional objectives are to provide an exercise system that is usable with the feet and hands in different exercising positions.

Yet another objective is to provide a hands-free, upper-body exercise apparatus that is durable in construction, carefree of maintenance, easily assembled, and simple and effective to use by using lower, upper arms instead of legs.

An exemplary objective is to provide an inexpensive to manufacture Spring exercise system that is ideal for home and travel use.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
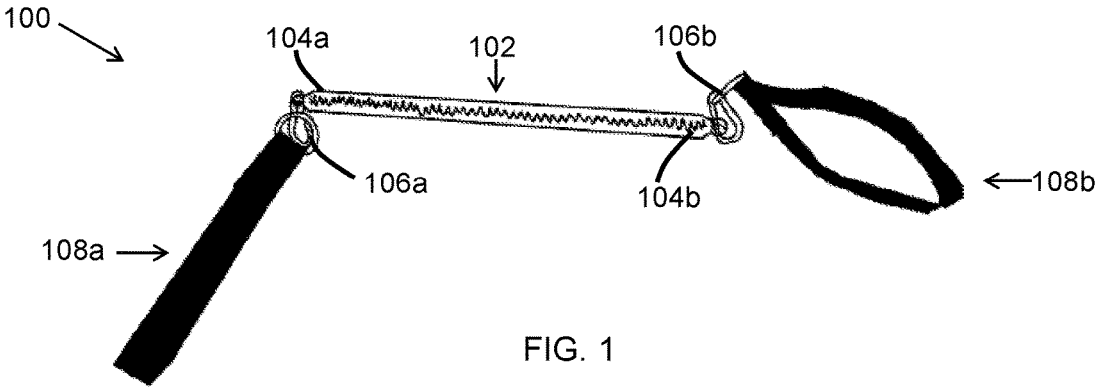
FIG. 1 illustrates a perspective view of an exemplary Spring exercise system, showing a resilient loop handle, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A spring exercise system 100 and method 3400 of exercising is referenced in FIGS. 1-34. The spring exercise system 100 comprises a spring 102 having one or more resistances efficacious for effective low-impact training, which can include, but is not limited to, Pilates exercises. The exercise system 100 provides a user with the capacity to change grasp handles types, and levels of spring resistance, so as to customize a unique exercise routine, which can be Pilates-style. Though, other types of exercise routines known to be low-impact and work the long muscles may also be used, such as yoga, Barre, ballet center work, as well as Pilates and other apparatus.

The spring 102, which serves as the primary resistance mechanism, is independent, and thereby not attached to exercise machinery or other stationary fixture. The grasp handles 108*a-b*, 202*a-b*, 302*a-b* on the ends of the spring 102 are interchangeable, so as to accommodate different styles of exercise, and comfort levels for the user. The grasp handles also accommodate the hands, feet, ankles, legs, wrists, arms, fingers, and stationary objects, so as to enable myriad permutations of exercise techniques, exercises and positions. A swiveling connector may or may not attach the free ends of the spring to the grasp handles. The connector mechanism enables the grasp handles/loops to rotate up to 360°, which further increases the types and difficulty levels of exercises and range of motion that can be accomplished.

As referenced in FIG. 1, the spring 102 comprises an extension spring. The extension spring is configured to absorb and store energy, as well as create resistance with a pulling or pressing force. The spring 102 is also unique in being a non-fixed spring 102. This means that the spring is not anchored to exercise equipment or otherwise. The spring 102 is free to move to any point that the user desires. In one embodiment, multiple users can use a single spring, or multiple springs in tandem to exercise. In yet another embodiment a single user may use multiple springs with multiple loops or handles. In one non-limiting embodiment, the spring 102 comprises a metal material. The material of the spring may be, in one instance, a nickel-plated metal alloy, such as hard carbon or stainless steel. In one non-limiting embodiment, the spring 102 comprises a plastic or engineered plastic material.

In some embodiments, the spring 102 includes a central coiled body, and a pair of opposing free ends 104*a*, 104*b*. The free ends 104*a-b* may terminate at a hook or a loop. The spring 102 has a central body section that is coiled to produce resistance when stretched, or pulled or pressed during exercise. The tightness of the coil and the material of the spring are determinative of the resistance provided by the spring 102. Thus, the spring 102 generates resistance to a pulling or pressing force when stretched. The resistance generated by the spring 102 generates an extension of resistance. Different levels of resistance in the spring may be used, depending on the requirements of the user.

For example, in one embodiment, the spring 102 is configured with a hard resistance level. In another embodiment, the spring 102 is configured with a medium resistance. In yet another embodiment, the spring 102 is configured with a soft resistance. Each resistance level supports a load while being stretched. Variation of resistance can also be achieved by adjusting the loop or grasp handle from shorter to longer, for example.

It is significant to note that the fixed spring defines, and is the common denominator, of Pilates apparatus—not the shape or form of the exercise machine. This is because such a spring-based concept has been employed with the Pilates method-based innovations and machines. In the prior art, whether one is lying down, sitting, kneeling, or standing the spring is fixed and applied directly (i.e. the trapeze table, et al) or indirectly (i.e. the Reformer). However, the present invention employs the spring 102 independently held or maneuvered by the extremities (hands and feet) that works the whole body for activating and orchestrating the core, torso, joint muscles, etc.

Those skilled in the art will recognize that the exercise motions of most upper-body exercises while isolating the hands, wrist, forearm, bicep and triceps allowing isolation of primary muscle groups of the chest, back and shoulders. Furthermore, the system provides comparable exercise benefit requiring approximately half of the weight or resistance the user would normally use in a given exercise. This in turn decreases the pressure and torque on joints, tendons and ligaments and reduces the risk of injury.

Figure 2:
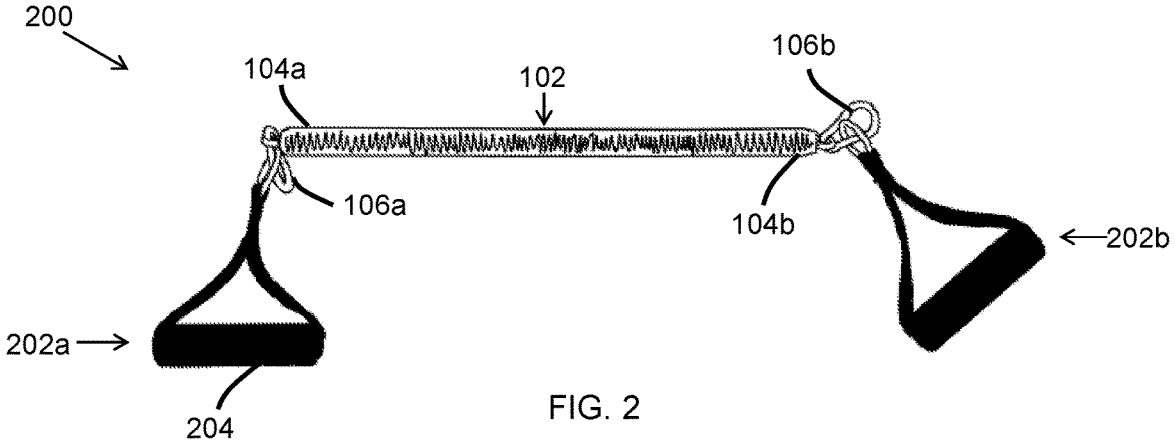
FIG. 2 illustrates a perspective view of the Spring exercise system, showing a single rigid handle, in accordance with an embodiment of the present invention.
Figure 3:
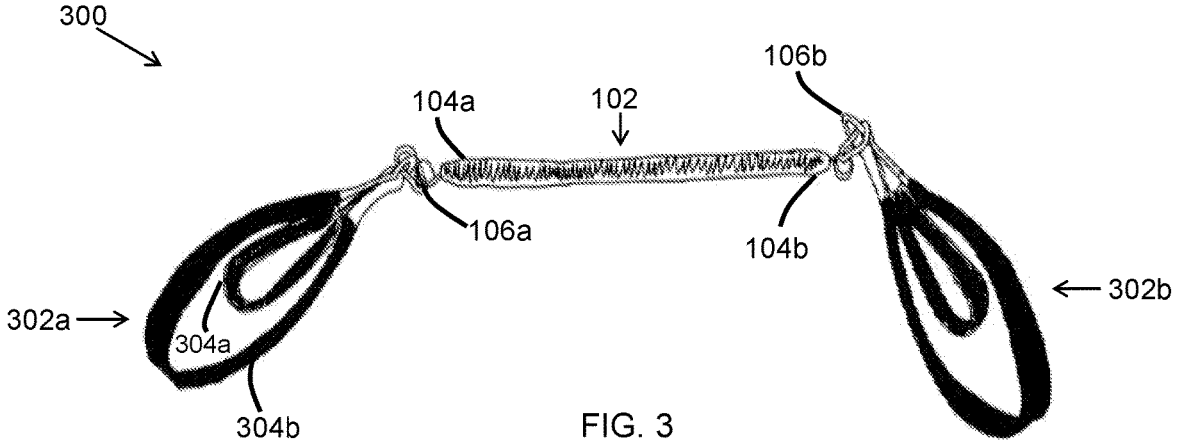
FIG. 3 illustrates a perspective view of the Spring exercise system, showing a resilient double loop handle, in accordance with an embodiment of the present invention.

Looking now at FIGS. 1-3, the system 100 includes a pair of grasp handles that attach to the free ends 104*a*, 104*b* of the spring 102. The grasp handle provides the structural means for the user to secure the spring from its ends, and stretch the spring 102, so as to achieve a 3-dimensional experience and the extension spring (See FIGS. 4-33). The grasp handles are configured to enable the hands, wrists, arms, the feet, and/or ankles. The grasp handles allow the spring 102 to be independently held by the extremities (hands and feet) that works the whole body. Suitable materials for the grasp handles may include, without limitation, leather, fleece, neoprene, and cloth.

As illustrated in the various exercise permutations possible with the system shown in FIGS. 4-33, the grasp handles are grasped or encircled by the hands and the feet to enable extension and retraction of the arms and legs for exercise of the intrinsic core stabilizers and long muscles. The grasp handles are interchangeable, and include three different and unique styles for optimal function during movement and exercises. Each grasp handle 108*a-b*, 202*a-b*, 302*a-b* supports a different exercise system 100, 200, 300, respectively. And two different handles or loops can be used on each end 104*a-b* of the spring 102, in any combination of handles or loops. This helps achieve the objective of interchanging multiple, different handles or loops 108*a-b*, 202*a-b*, 302*a-b* on the ends of the spring 102.

Figure 4A:
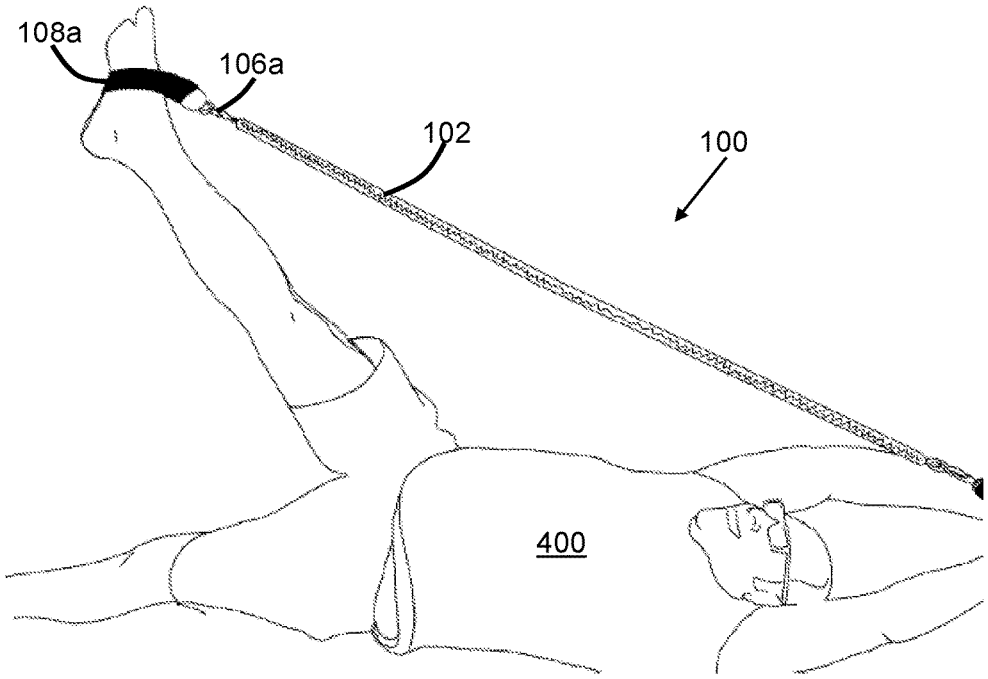
FIGS. 4A-4B illustrate perspective views of a user exercising with the system, showing the fundamental es Stretch position, where the hands are grasping a first resilient loop handle, and the feet passing through and butting against a second resilient loop handle, while the user extends the arms and legs to generate an extension of resistance, in accordance with an embodiment of the present invention.
Figure 4B:
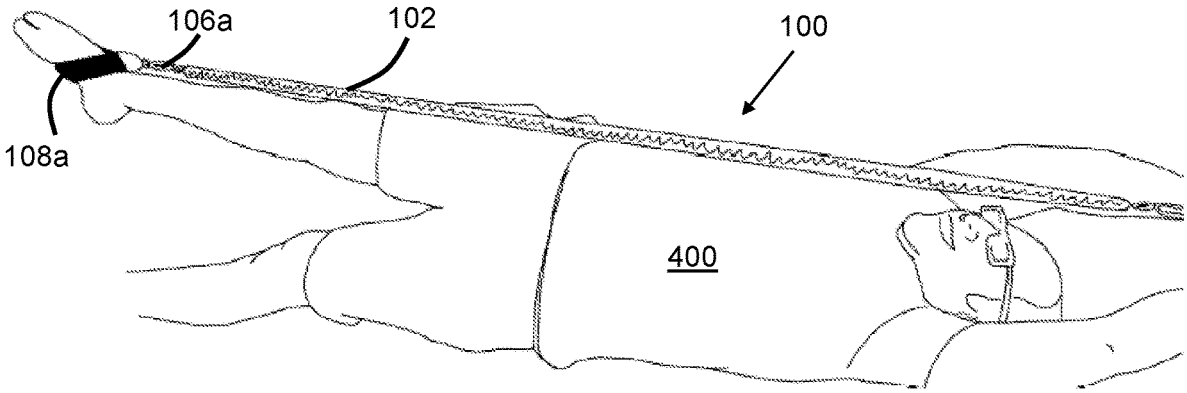

In one possible embodiment of the exercise system 100 FIG. 1 shows the handles 108*a*, 108*b* are resilient loop handles that forms a loop through which the fingers of the hand or the foot can pass through. The resilient loop handle may simply be a loop of a resilient neoprene, cloth or leather that is versatile enough to be used by the hand or arm, or allow the foot or leg to pass through. Thus, as illustrated in FIGS. 4A-4B, the user inserts both hands and arms to pass through the grasp handles/loops 108*a-b* while performing a Fundamental Stretch position 400, where the hands are moving a first resilient loop handle 108*a*, and one is passing through a second resilient loop handle 108*b*. This allows the user to extend the arms and legs to generate an extension of resistance through the zone from the extremities. Furthermore, in the Fundamental Stretch position 400, the user can lie supine, and extend and retract the spring 102.

Figure 5A:
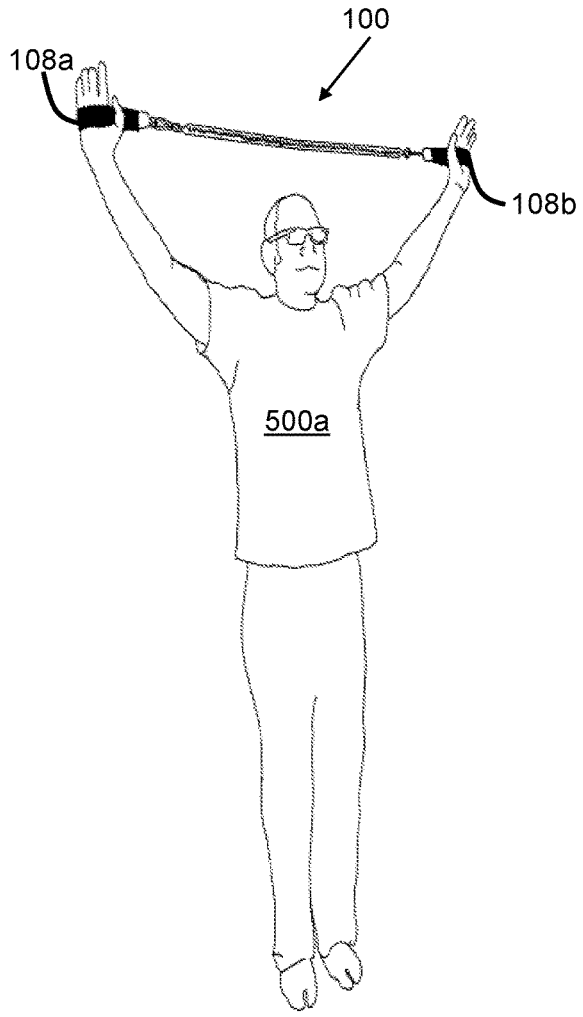
FIGS. 5A-5B illustrate perspective views of a user exercising with the system, showing the user standing in the es Salutation position to stretch the spring laterally, and bending at the waist in the Yoga Triangle Prep position while stretching the spring, in accordance with an embodiment of the present invention.
Figure 5B:
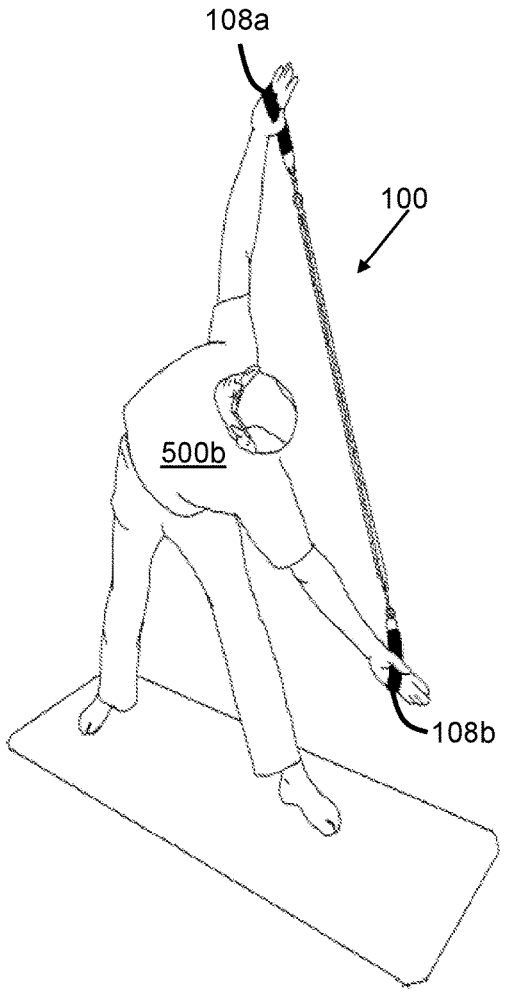

However, as FIG. 5A references, the user can also stand straight up in a fundamental Salutation position 500*a* to stretch the spring laterally while grasping the loops 108*a-b*. This allows the user to stretch the spring 102 and generate resistance in the spring 102. And as shown in FIG. 5B, the user can also bend at the waist in the Yoga Triangle Prep position 500*b* while stretching the spring 102 with the arms. These unique stretching positions 500*a-b* create a Novel exercise routine that allows the user to have a secure grasp while stretching the spring 102 to the desired length to generate the optimal extension of resistance. In each position 500*a*, 500*b*, the upper body core, shoulder girdle and the long muscles of the arm are being worked.

In another embodiment, an exercise system 200 utilizes a pair of loops 202*a*, 202*b*. The resilient loop, rotatably attaches to each end 104*a*, 104*b* of the spring 102 (See FIG. 2). The single loop includes a grasp bar 204, which can be grasped by the user, and is connected to the free ends of the spring 102 through a pair of resilient straps 206*a*, 206*b*.

Figure 6A:
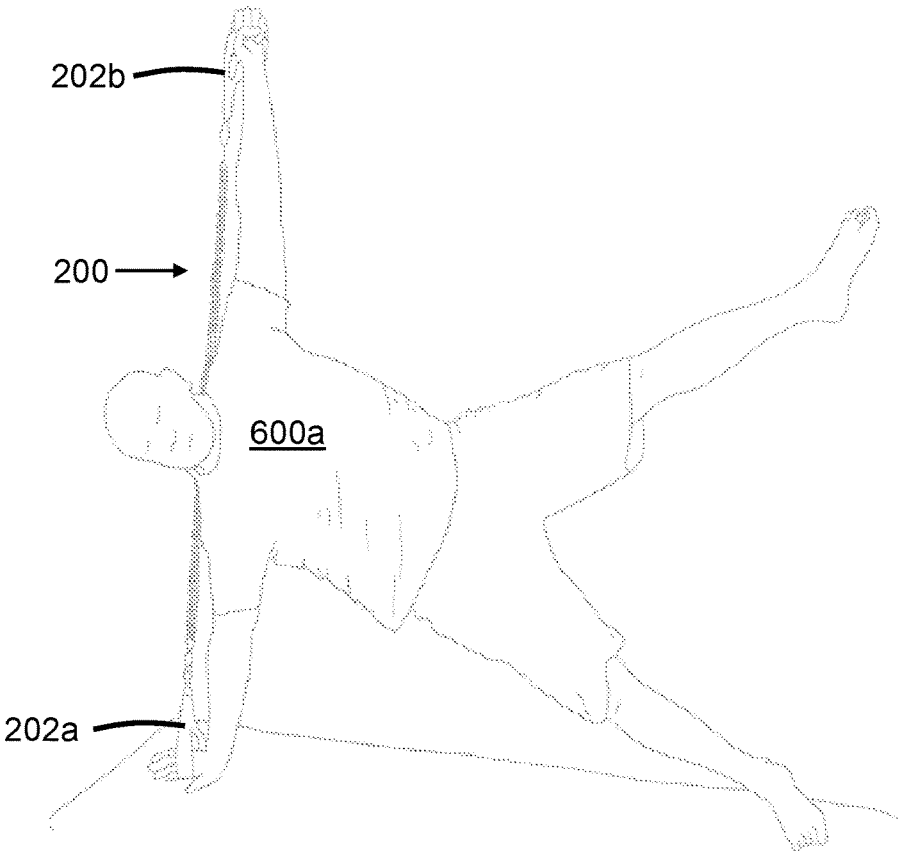
FIGS. 6A-6B illustrate perspective views of a user exercising with the system, showing the user on an exercise mat in the Pilates Mat Star Position with one hand and one foot on the mat and the opposing hand and foot projecting upwardly while stretching the spring with the arms, and the Star Twist position with the user facing the mat and having two feet and one hand on the mat while stretching the spring with the arms, in accordance with an embodiment of the present invention.
Figure 6B:
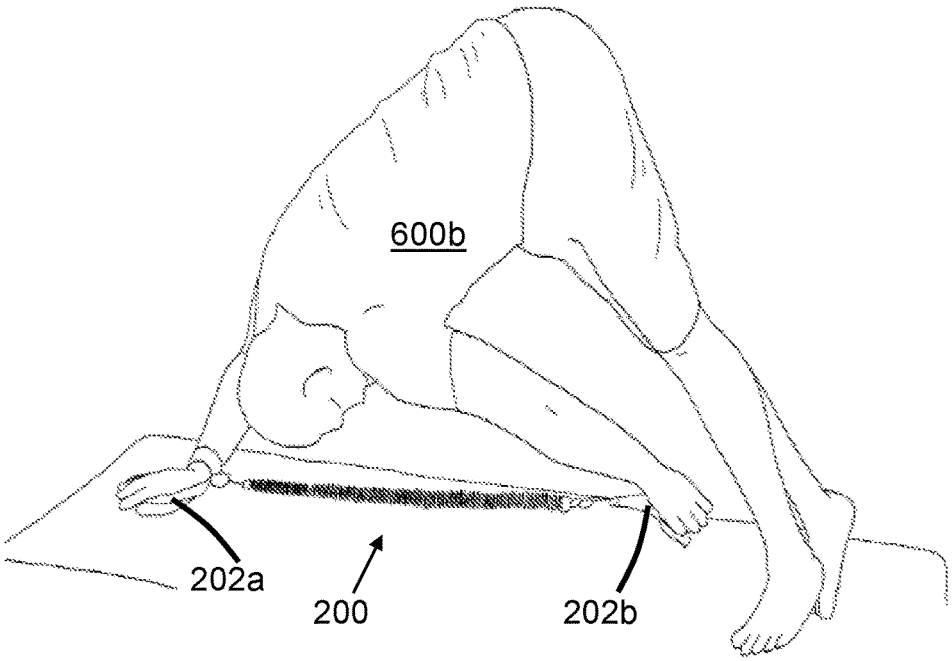

FIGS. 6A and 6B illustrate use of the loops 202*a-b* where the user works on an exercise mat in a Pilates Star Position 600*a* with one hand and one foot on the mat and the opposing hand and foot projecting upwardly while stretching the spring with the arms. FIG. 6B reference a Star Twist position 600*b* in which the user is in a pike position with both feet and one hand flat on the mat, and stretching the spring with the arms, shoulder and legs.

In another embodiment of the exercise system 300, the loop 302*a*, 302*b* is a resilient double loop handle, which enables the user to securely utilize each end 104*a*, 104*b* of the spring 102 (See FIG. 3). The resilient double loop handle comprises an inner loop 304*a* and an outer loop 304*b*. The inner loop 304*a* is operable to enable grasping by the hand. The outer loop 304*b* can be wrapped around the wrist, foot or leg. In some embodiments, the outer loop 304*b* of the resilient double loop handle 302*a-b* has a greater resilience than the inner loop.

Figure 12A:
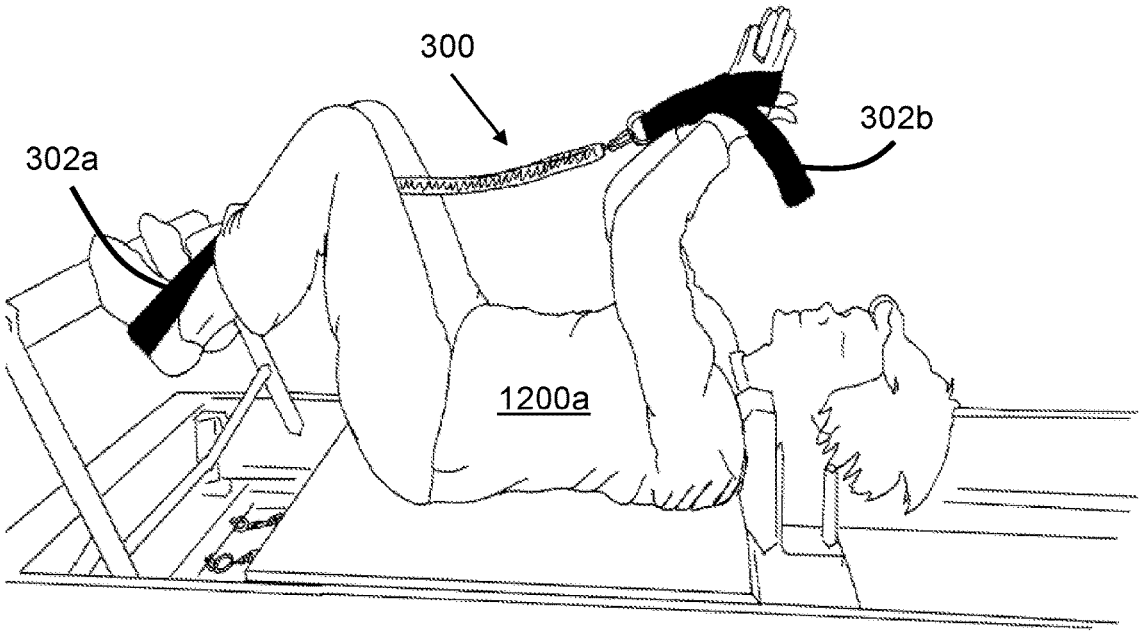
FIGS. 12A-12C illustrate perspective views of a user exercising with the system, with FIG. 12A showing the Pilates Reformer Footwork—Basic Length—Slack position, FIG. 12B showing the Pilates Reformer Footwork—Basic Length—Stretch position, and FIG. 12C showing the Pilates Reformer Footwork—Basic Lateral—Stretch position, in accordance with an embodiment of the present invention.
Figure 12B:
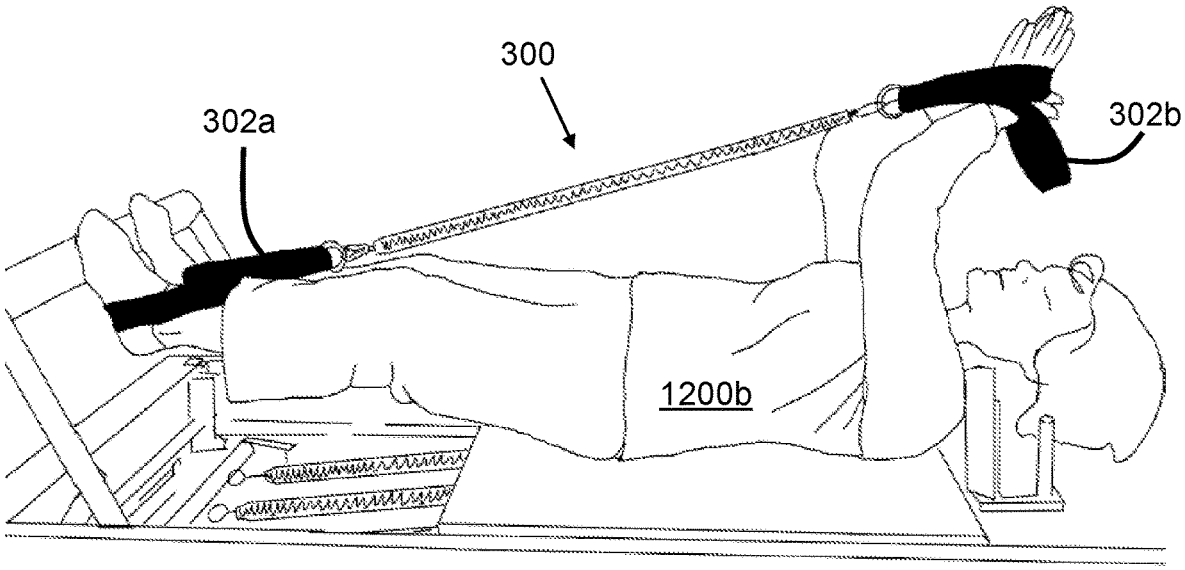
Figure 12C:
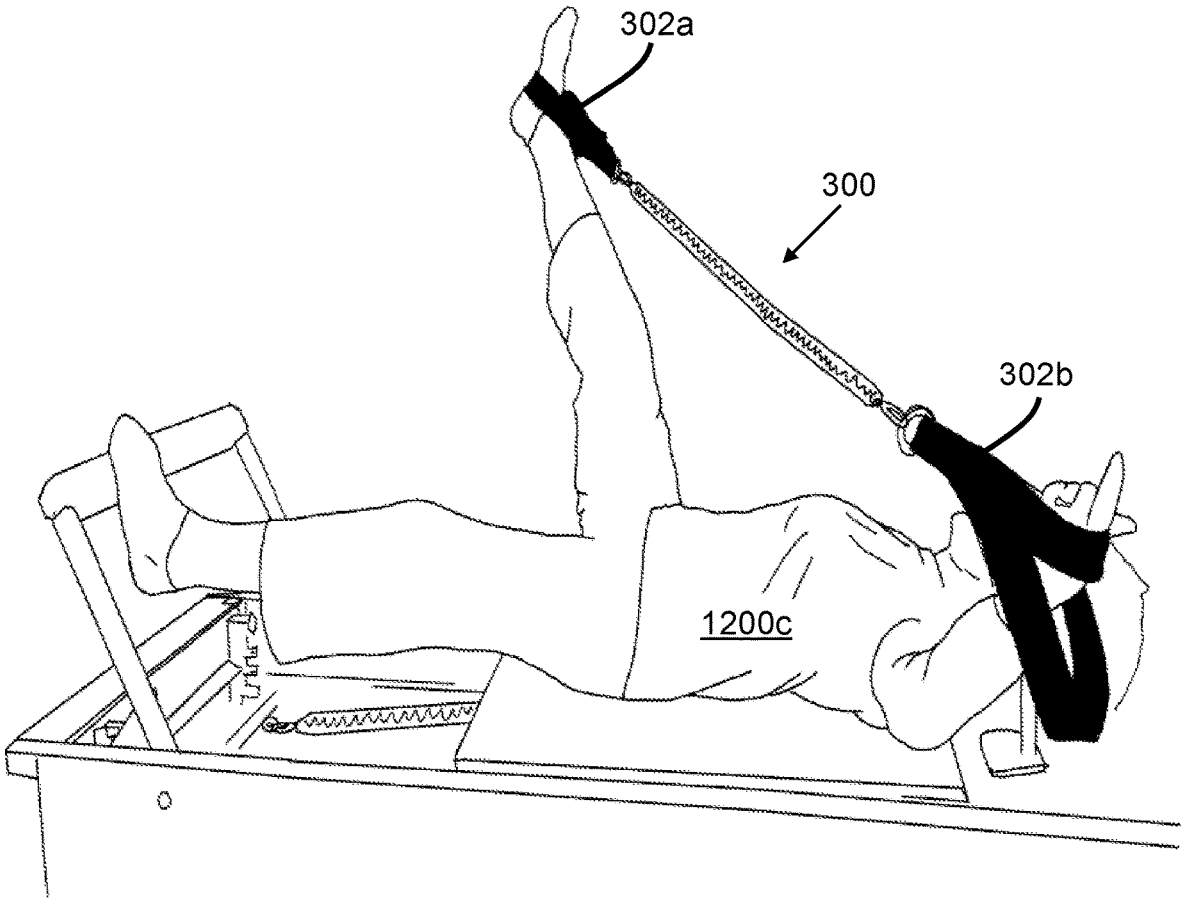

Looking ahead to FIGS. 12A-12C, the resilient double loop handle is grasped by the user while lying on Pilates Reformer. FIG. 12A references a Pilates Reformer Footwork—Basic Length—Slack position 1200*a* with the user passing the hands, palms through the outer loop 304*b*, and the thumbs through the inner loop 304*a*. The user's arms and legs are retracted and relaxed in this position 1200*a*. Continuing, FIG. 12B illustrates a Pilates Reformer Footwork—Basic Length—Stretch position 1200*b* with the user extending the arms and legs to create tension on the spring 102. And FIG. 12C shows a Pilates Reformer Footwork—Basic Lateral—Stretch position 1200*c* with the user laterally extending the right leg to create tension thereon. The double loops 302*a-b* in this configuration allows the hands and the foot to pass through the inner loops for more effective control of the spring 102.

In some embodiments, the system 100 may include a pair of swiveling connectors 106*a*, 106*b* that are disposed at each of the free ends 104*a*, 104*b* of the spring 102. The swiveling connectors 106*a-b* are configured to connect to the grasp handles/loops 108*a-b*, 202*a-b*, 302*a-b* to the free ends 104*a-b* of the spring 102. This may utilize a swiveling linkage, as is known in the art. The swiveling connectors 106*a-b* provide a unique *nexus* that allows the grasp handles/loops 108*a-b*, 202*a-b*, 302*a-b* to rotate up to 360°, relative to the spring 102. This rotation by the grasp handles allows for greater range of motion at the wrist and ankles while stretching the spring. This serves to enhance the exercise routine.

For example, FIG. 6A shows the arm extends laterally to stretch the long muscles. And FIG. 6B shows the left wrist contorted at an angle, but still grasping the grasp handle 202*b*, which can rotate to accommodate the wrist and ankle motions. It is significant to note that the illustrated exercises reference the versatility of the exercise system, but represent only a limited number of exercises that are possible by grasping the grasp handles and stretching the spring.

Figure 34:
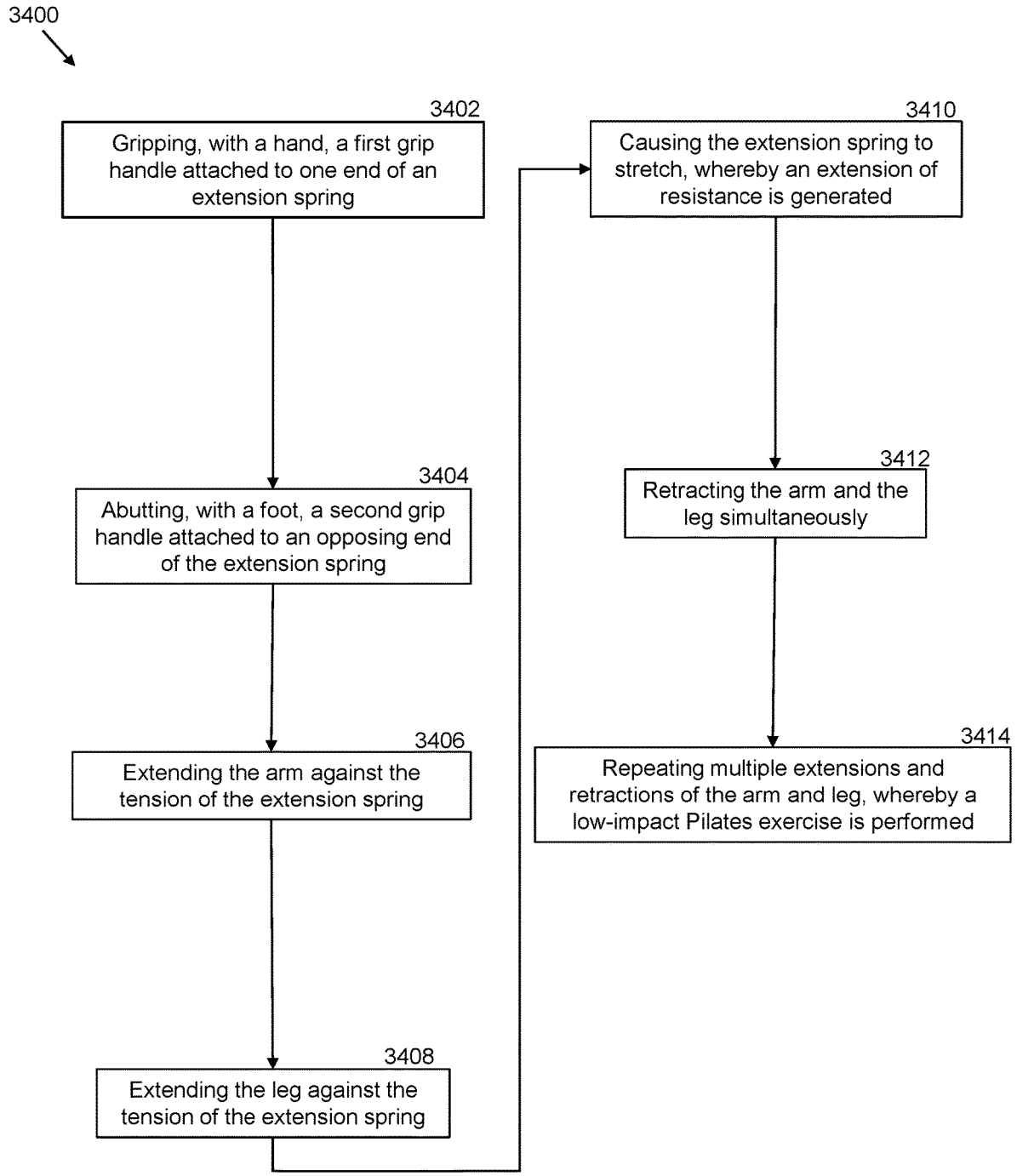
FIG. 34 illustrates a flowchart of an exemplary method of exercise with a Spring exercise system, in accordance with an embodiment of the present invention.

FIG. 34 illustrates a flowchart diagram of an exemplary method 3400 for exercising with the Spring exercise system. The method 3400 may include an initial Step 3402 of grasping, with a hand, a first grasp handle attached to one end of an extension spring. In other embodiments, the foot passes through and engages the first loop. The first loop may include, without limitation, a resilient loop, a single rigid handle, and a resilient double loop. The user grasps the first loop to manipulate one end of the spring.

The method 3400 may further comprise a Step 3404 of abutting, with a foot, a second loop attached to an opposing end of the extension spring. In other embodiments, the hand grabs the second loop. The second loop may include, without limitation, a resilient loop, a single rigid handle, and a resilient double loop. The user grasps the second loop to manipulate the opposing end of the spring. In this manner, both ends of the spring can be stretched to achieve the exercise. The loops are able to be grasped with different combinations of the hands and feet, so as to generate an extension of resistance that strengthens the long muscles, enhances flexibility, and emphasizes proper postural alignment, core strength, and muscle balance.

In some embodiments, a Step 3406 includes extending the arm against the tension of the extension spring. This serves to work the long muscles in the arm. The method 3400 may further utilize a Step 3408 of extending the leg against the tension of the extension spring. This stretching motion strengthens the long muscles in the leg. A Step 3410 includes causing the extension spring to stretch, whereby an extension of resistance is generated. The spring is configured to generate resistance to a pulling or pressing force when stretched. The level of resistance can be changed by the user through selection of different resistance levels of springs. Thus, the spring can be interchanged to achieve a desired resistance level.

In some embodiments, a Step 3412 may include retracting the arm and the leg simultaneously. This motion returns the arms and/or legs to the natural position for another round of stretching. A final Step 3414 includes repeating multiple extensions and retractions of the arm and leg, whereby a low-impact exercise is performed. This repetitive motion strengthens the long muscles, enhances flexibility, and emphasizes proper postural alignment, core strength, and muscle balance. In this manner, different styles of exercises, including Pilates, yoga, barre, etc., are possible.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Figure 7A:
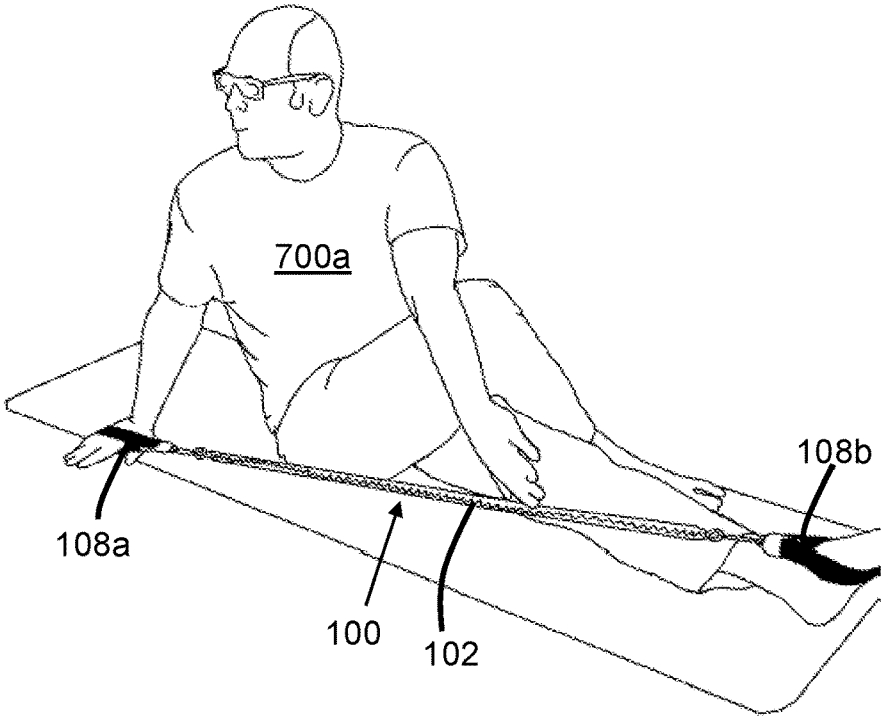
FIGS. 7A-7B illustrate perspective views of a user exercising with the system, showing the user on an exercise mat in the Yoga Seated twist position, and the yoga pigeon position, in accordance with an embodiment of the present invention.
Figure 7B:
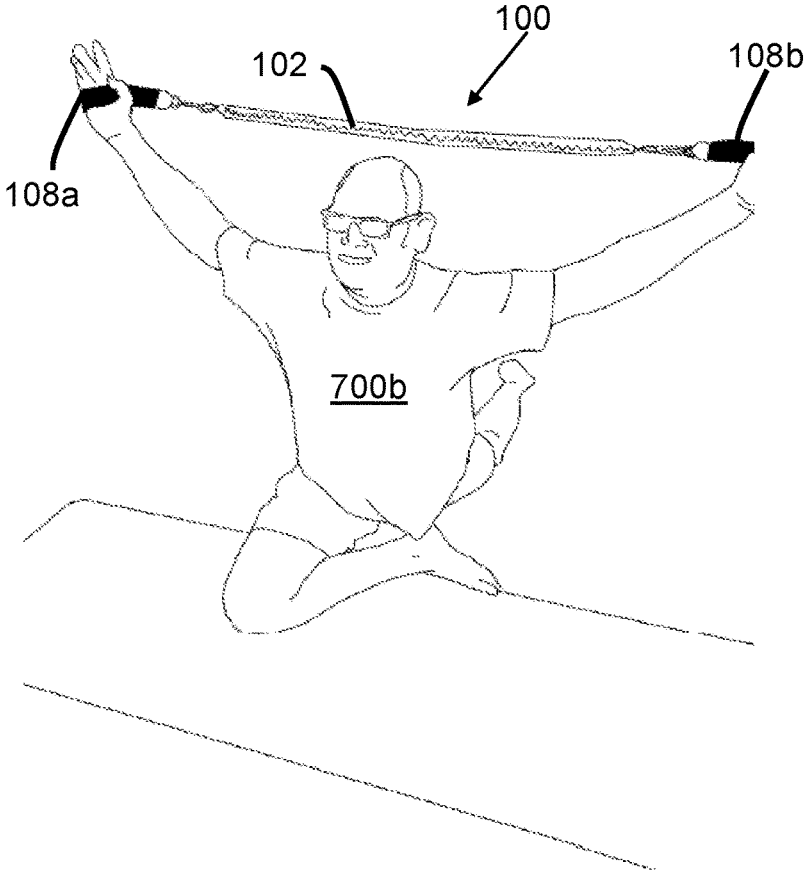

These unique steps for the method 3400 allow for the creation of multiple exercise routines that utilize the different loops 108*a-b*, 202*a-b*, 302*a-b* and exercise machine equipment. Different spring resistances are also used. For example, FIGS. 7A-7B illustrate a user exercising with the system 100, with FIG. 7A illustrating the user on an exercise mat in a Yoga Seated position 700*a*. In the Yoga Seated position 700*a* the hands and feet grasping the loops 108*a-b*, and the user stretching the spring. FIG. 7B references the Dove position 700*b* with the arms extending towards the back while stretching the spring 102.

Figure 8A:
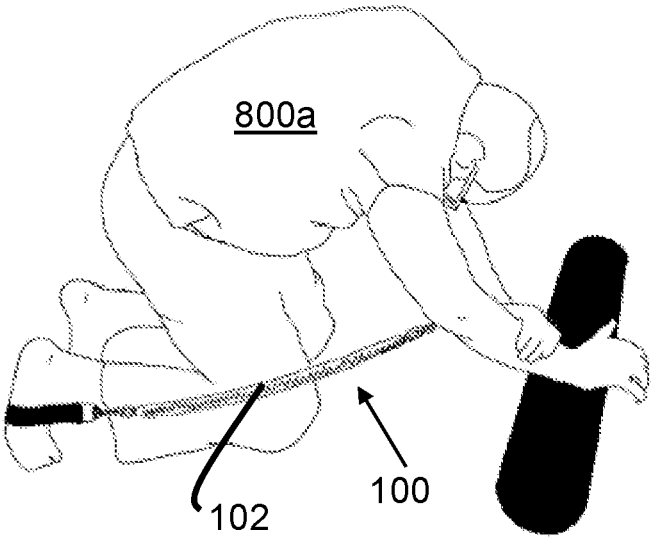
FIGS. 8A-8B illustrate perspective views of a user exercising with the system, showing the user in the Foam Roller Flexion position, and the Foam Roller Extension position, in accordance with an embodiment of the present invention.
Figure 8B:
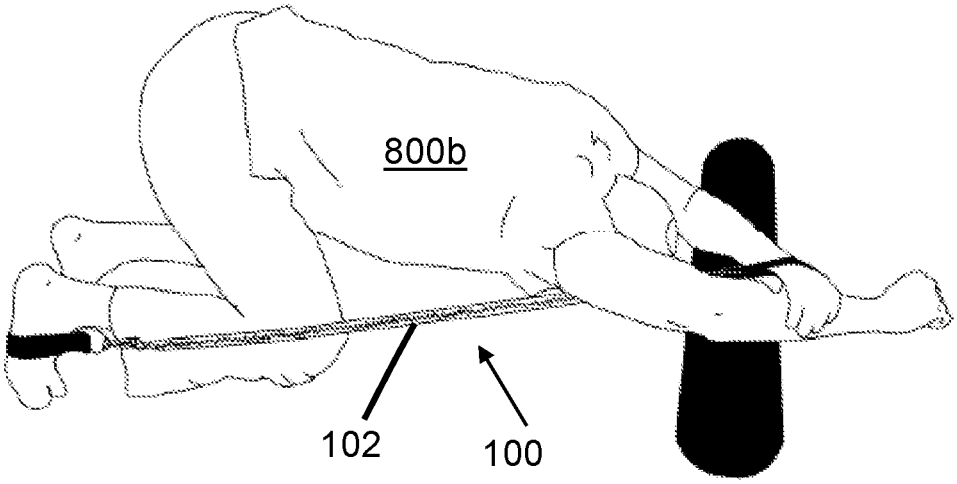

In one exercise routine possible through the method 3400, a user utilizes a cylindrical support member to work the core of the body and the long muscles of the arms. As illustrated in FIGS. 8A-8B the user moves to a Foam Roller Flexion position 800*a* with the arms resting on the cylindrical support member and the arms retracted. The system 100 also allows the user to perform the Foam Roller Extension position 800*b* with the arms resting on a cylindrical support member and the arms extended to stretch the spring 102. This unique position 800*a-b* stretches and works the core and arms muscles.

Figure 9:
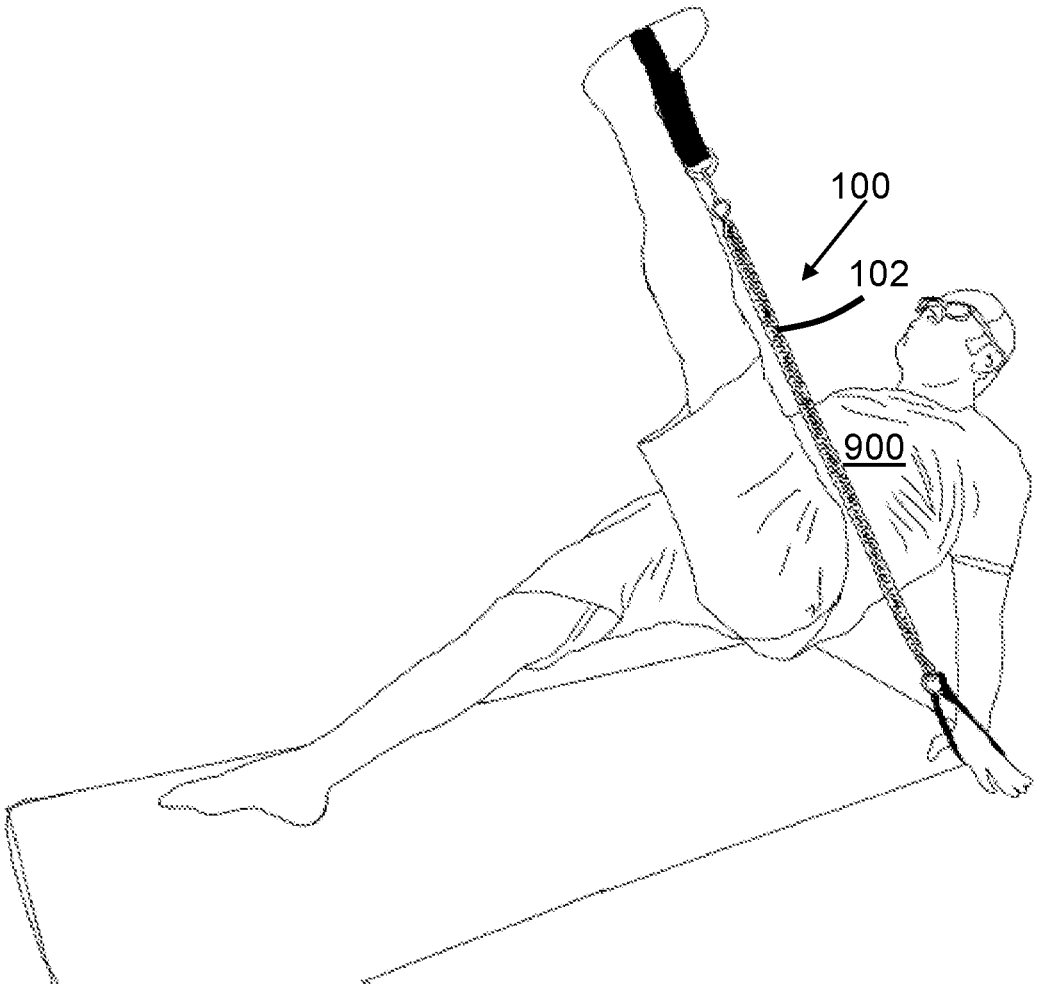
FIG. 9 illustrates a perspective view of a user exercising with the system, showing the user on an exercise mat in the Pilates—Leg Pull Front position, in accordance with an embodiment of the present invention.
Figure 10A:
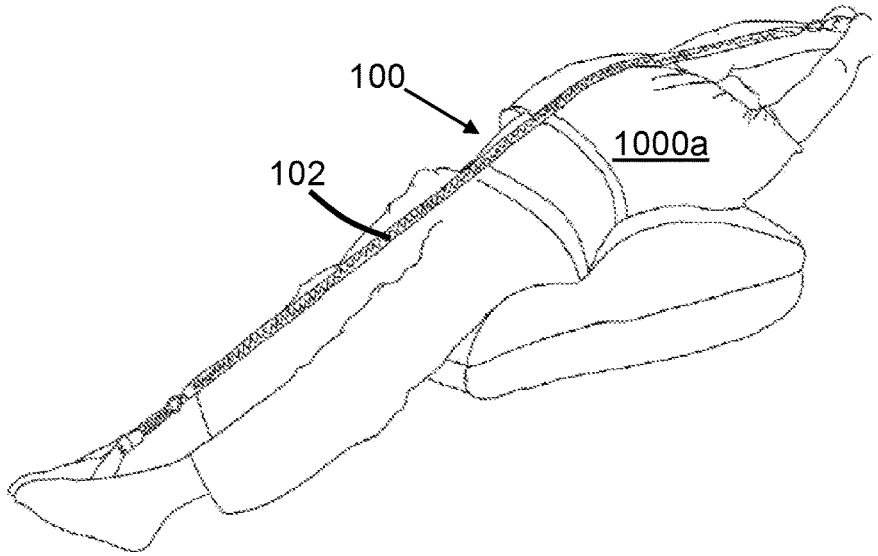
FIGS. 10A-10B illustrate perspective views of a user exercising with the system, showing the user on a foam version in the Pilates—Spine Corrector apparatus, in accordance with an embodiment of the present invention.
Figure 10B:
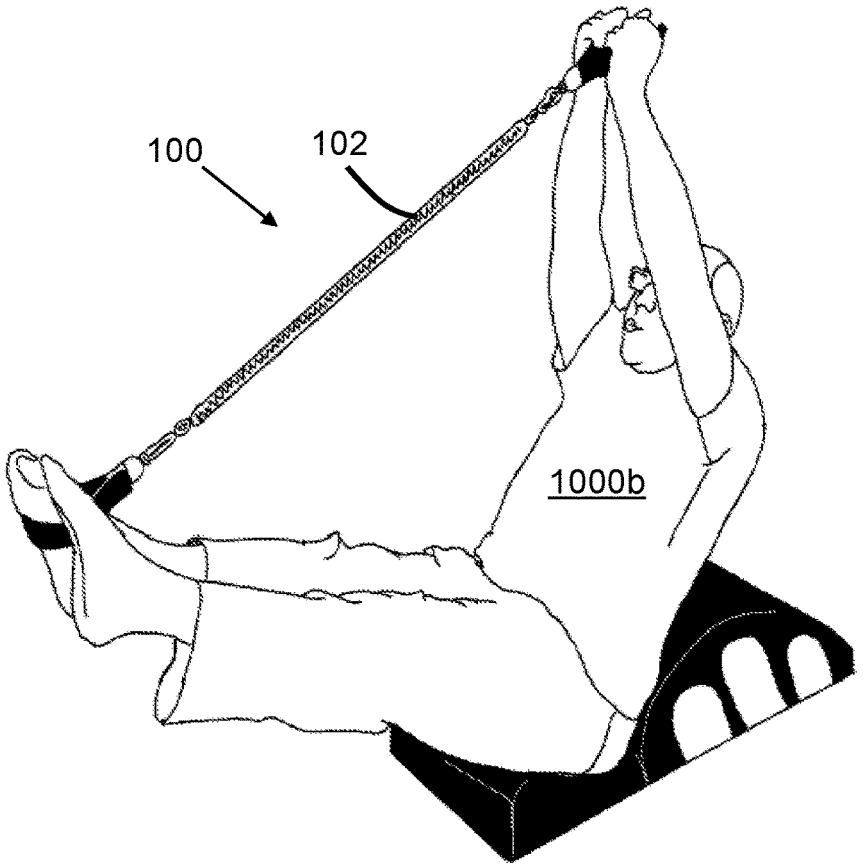

Continuing with exercise routines, FIG. 9 illustrates a perspective view of a user exercising with the system 100, showing the user on an exercise mat in a Pilates—Leg Pull Front position 900. In another example of a Pilates exercise, FIGS. 10A-10B reference a user exercising with the system, showing the user on a Pilates—Spine Corrector™ in an extension position 1000*a* and a flexion Pilates—Spine Corrector™ position 1000*b* with the user resting on barred shaped support while stretching the spring 102 between the feet and hands.

Figure 11:
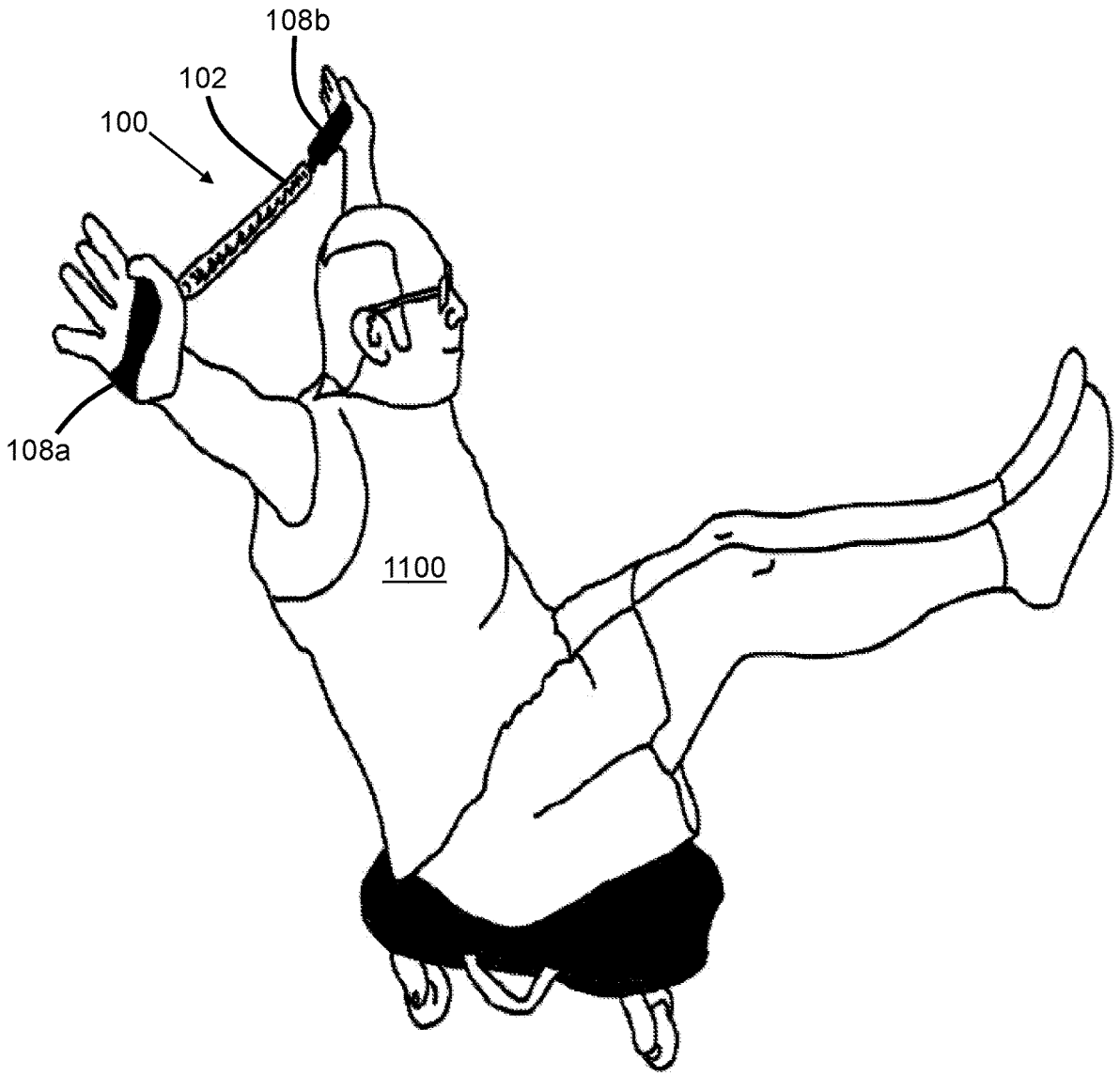
FIG. 11 illustrates a perspective view of a user exercising with the system, showing the user on a wheeled device, the Pilates, Pilates Wheeled Exercise Device™ position, in accordance with an embodiment of the present invention.
Figure 13A:
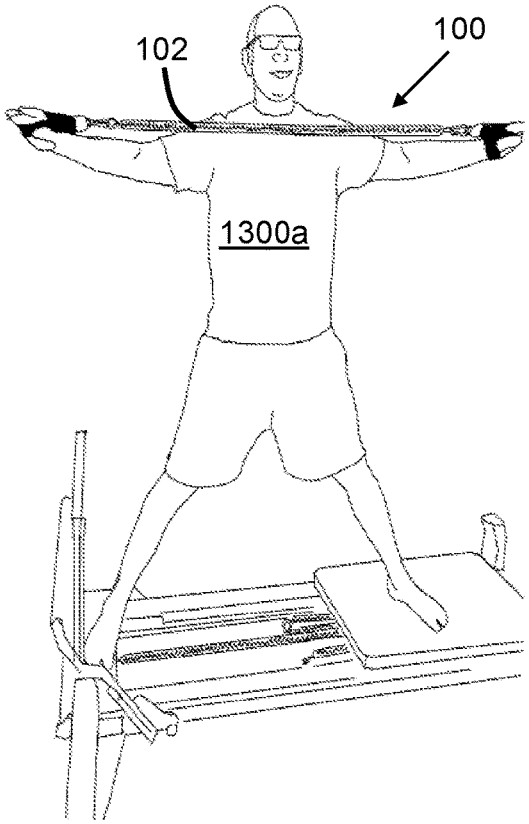
FIGS. 13A-13B illustrate perspective views of a user exercising with the system, showing the user on the Pilates Reformer—Standing Splits—demonstrating the double apparatus (also called dual system, two tier system, or dualistic system) quality, in accordance with an embodiment of the present invention.
Figure 13B:
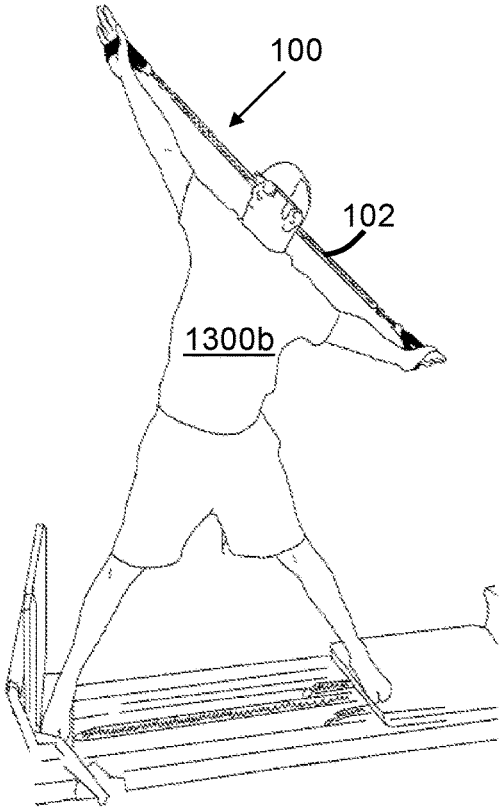

Continuing with exercise techniques from the method 3400, FIG. 11 shows the user on a Wheeled Pilates Exercise Device™ position 1100 with the arms behind the head and the spring being stretched laterally. FIGS. 13A-13B reference the user exercising with the system, showing the user in the Pilates Reformer—Standing Splits—Double Apparatus System position 1300*a* and a Pilates Reformer—Rotating Standing Splits—Double Apparatus System position 1300*b* with the apparatus attached to the legs while the user stands on a slide machine, and simultaneously stretches the spring with the arms.

Figure 14A:
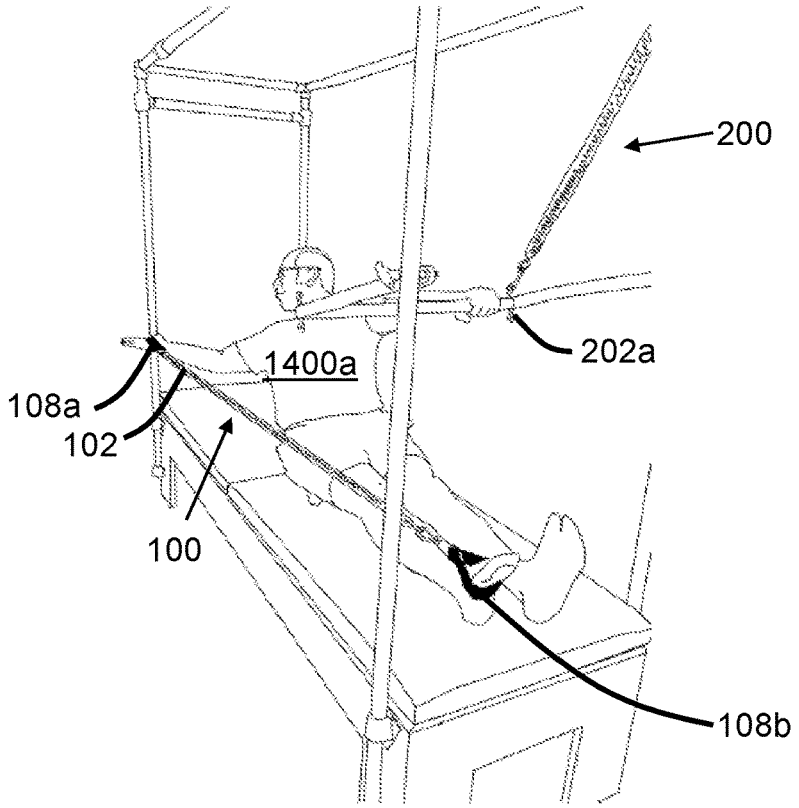
FIGS. 14A-14B illustrate perspective views of a user exercising with the system, showing the user on a trap table on the Pilates Trap Table—Push Through Plus Rotation exercise, in accordance with an embodiment of the present invention.
Figure 14B:
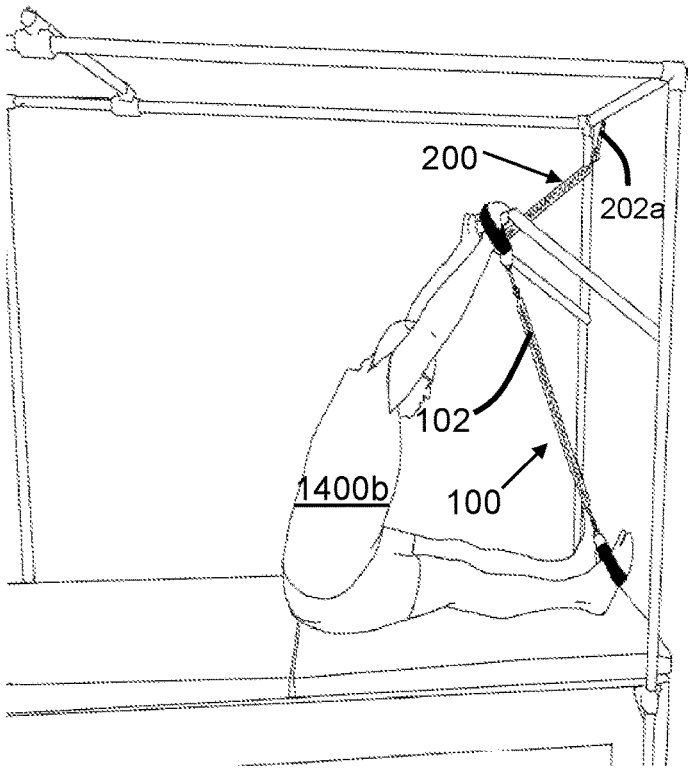

In another exercise technique, FIGS. 14A-14B reference the user on a Pilates Trapeze Table—Push Through Plus Rotation position 1400*a* and a Pilates Trapeze Table—Push Through Plus Sitting position 1400*b* with the user utilizing loop. The user stretches the right side of the body, with the spring offering resistance between the foot and hand. The left hand of the body clasps the push through bar of which is attached to the trap table, thus allowing for push through plus rotation with the squatted between the right hand and the foot resistance, and thereby working spine rotation and the long muscles of the arm and core.

Figure 15:
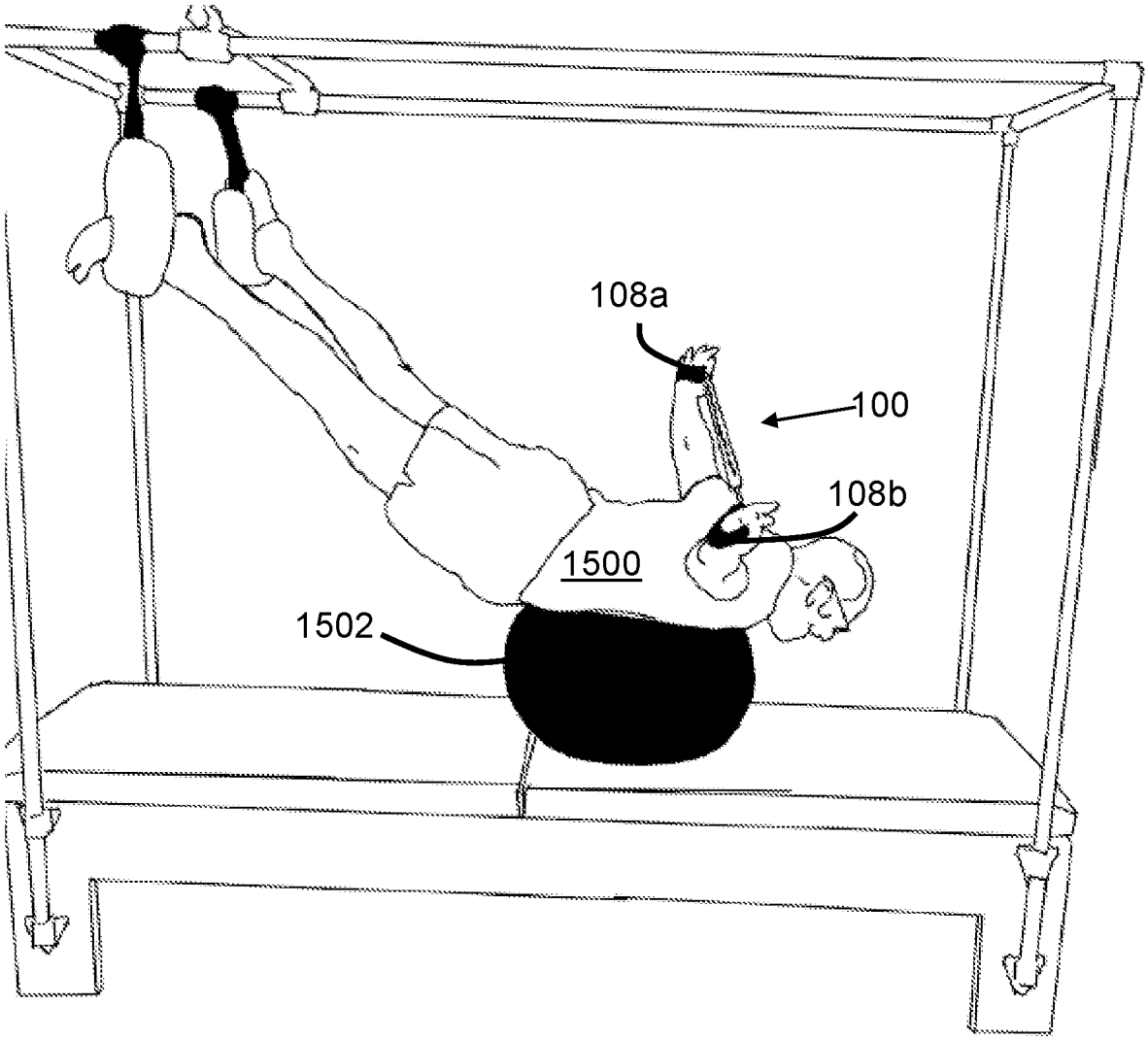
FIG. 15 illustrates a perspective view of a user exercising with the system, showing the user on a trap table on the Pilates Trapeze Table—Advanced Skydiver exercise with physio-ball, in accordance with an embodiment of the present invention.
Figure 16A:
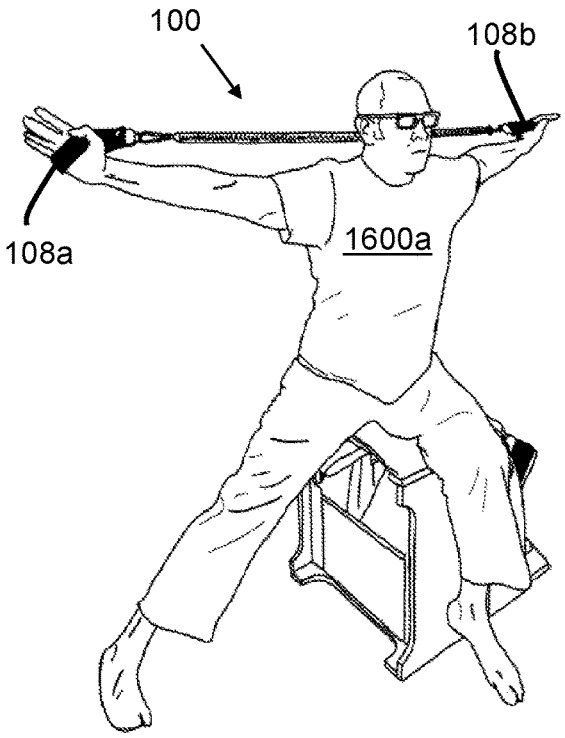
FIGS. 16A-16B illustrate perspective views of a user exercising with the system, showing the user on the Pilates Wunda Chair™ seated position and the Pilates Wunda Chair™ step-up exercise, in accordance with an embodiment of the present invention.
Figure 16B:
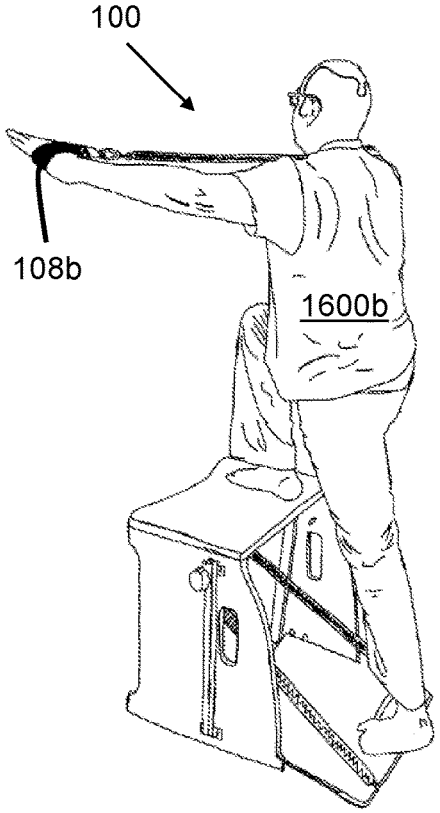

In yet another exercise technique, FIG. 15 illustrates the user being supported on a physio ball 1502 on a Pilates Trap Table—Advanced Skydiver position 1500. In this position, the legs are supported from an upper frame, and the chest rests on the physio ball 1502, while the user stretches the spring behind the back in an Eagle pose. FIGS. 16A-16B illustrate perspective views of a user exercising with the system, showing the user on the Pilates Wunda Chair™ position 1600*a* and a Pilates Wunda Chair™ position 1600*b* with the user stretching the spring between the hands in front and rear of the torso. This is an effective position for generating resistance in the spring 102 to work the arm, leg, and core muscles.

Figure 17A:
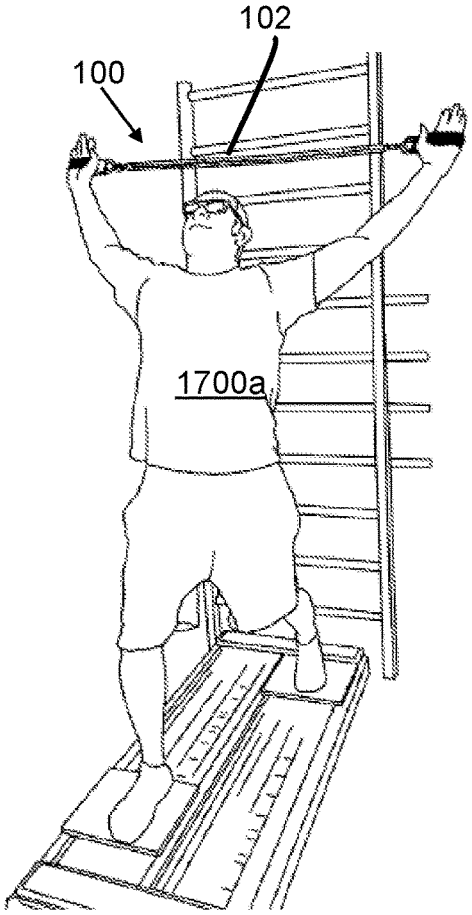
FIGS. 17A-17B illustrate perspective views of a user exercising with the system, showing the user on a track on the CoreAlign™ apparatus—Yoga Warrior Hand-to-Hand position, and the Warrior with Rotation Hand-to-Foot position, in accordance with an embodiment of the present invention.
Figure 17B:
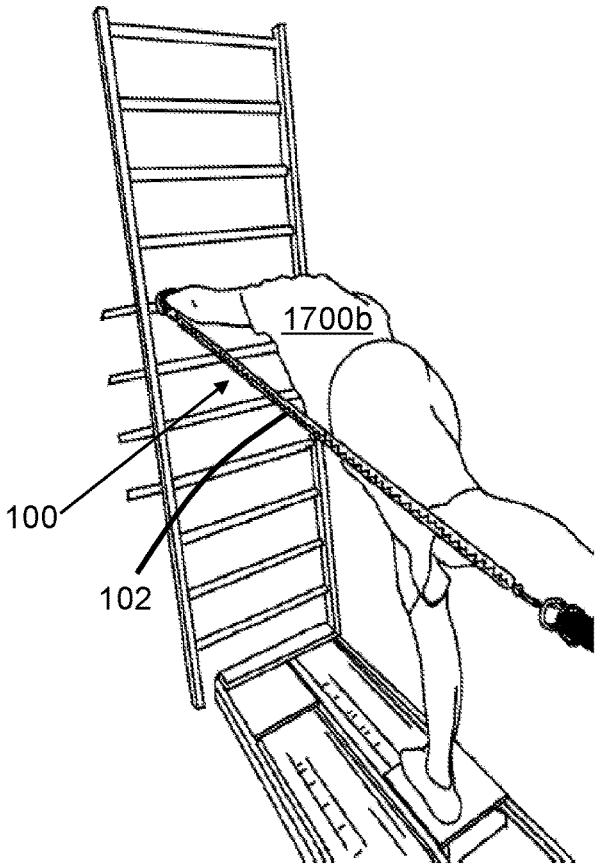
Figure 18A:
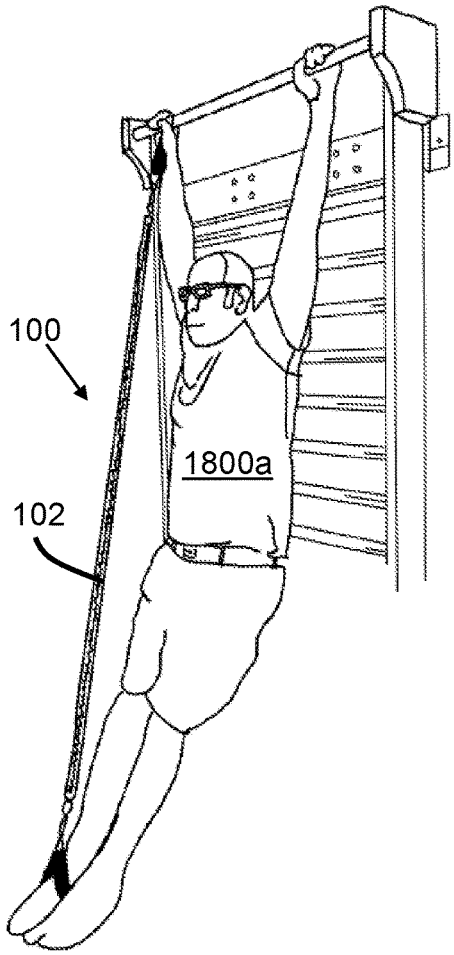
FIGS. 18A-18B illustrate perspective views of a user exercising with the system, showing the user on the Pilates/Swedish Ladder Hanging Leg Raise exercise, and/or the Pilates Ladder Handstand exercise, in accordance with an embodiment of the present invention.
Figure 18B:
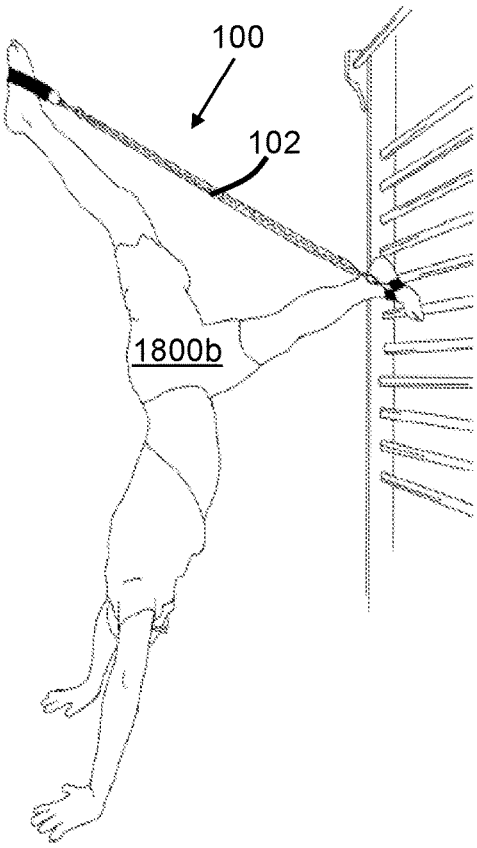

In yet another exercise technique, FIGS. 17A-17B illustrate the user on a track on the CoreAlign™—yoga Warrior Hand-to-Hand exercise (AKA c5 standing Eagle/moving lunge) 1700*a* with the user sliding the feet along a slide track while raising hip, the hands and the spring above the head during stretching. Another exercise is the Warrior with Rotation Hand-to-Foot position 1700*b*, in which the spring attaches to the hand and foot on the same side of the body during stretching. FIGS. 18A-18B illustrate the user in the Pilates Ladder Hanging Leg Raise exercise 1800*a* with the user hanging from a bar and the spring extended between the hand and foot. A Pilates Ladder Handstand position 1800*b* has the user performing a handstand while the spring extends between the foot and leg while being stretched.

Figure 19:
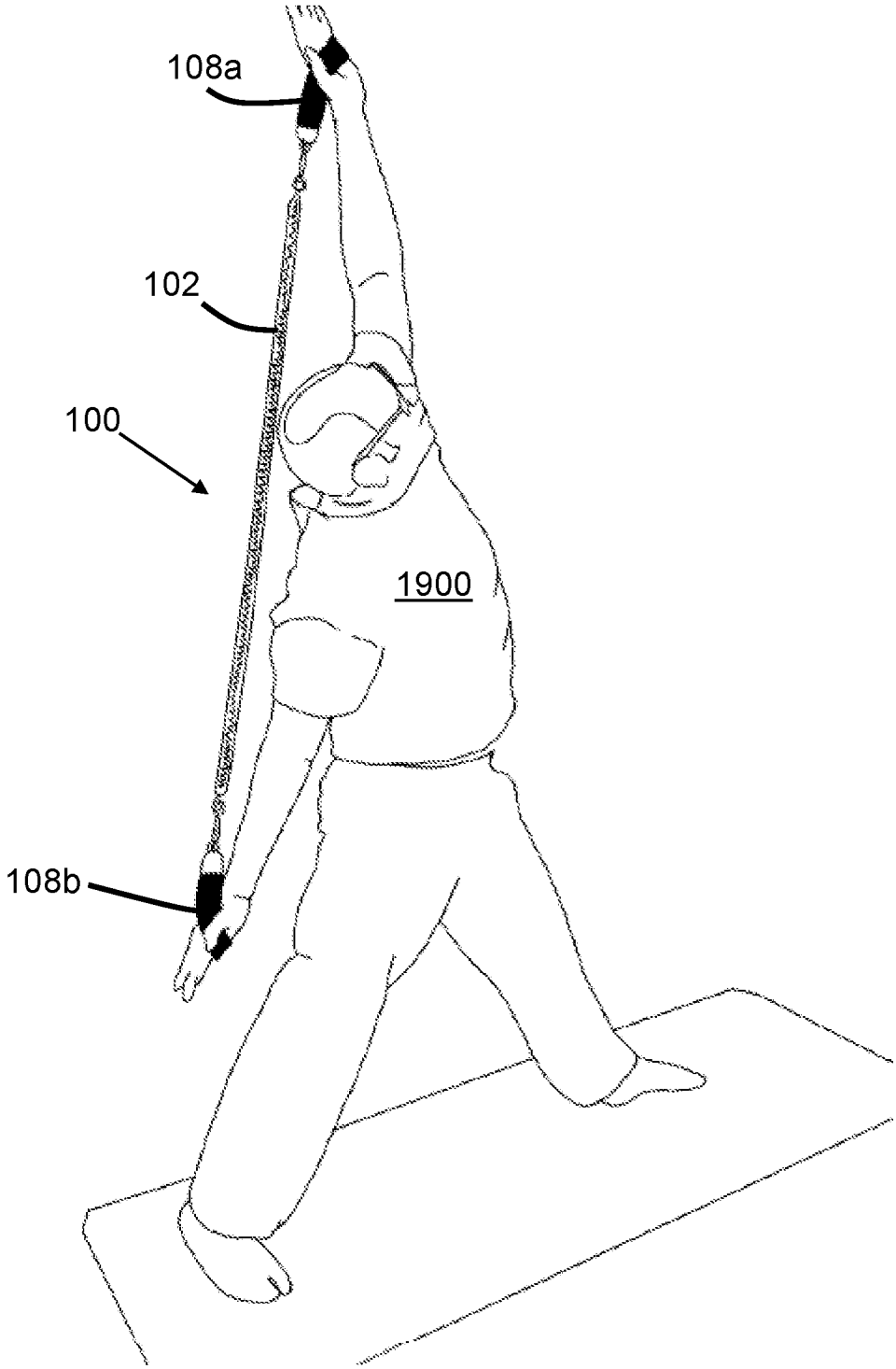
FIG. 19 illustrates a perspective view of a user exercising with the system, showing the user in the Standing Yoga Reverse Triangle position, in accordance with an embodiment of the present invention.
Figure 20:
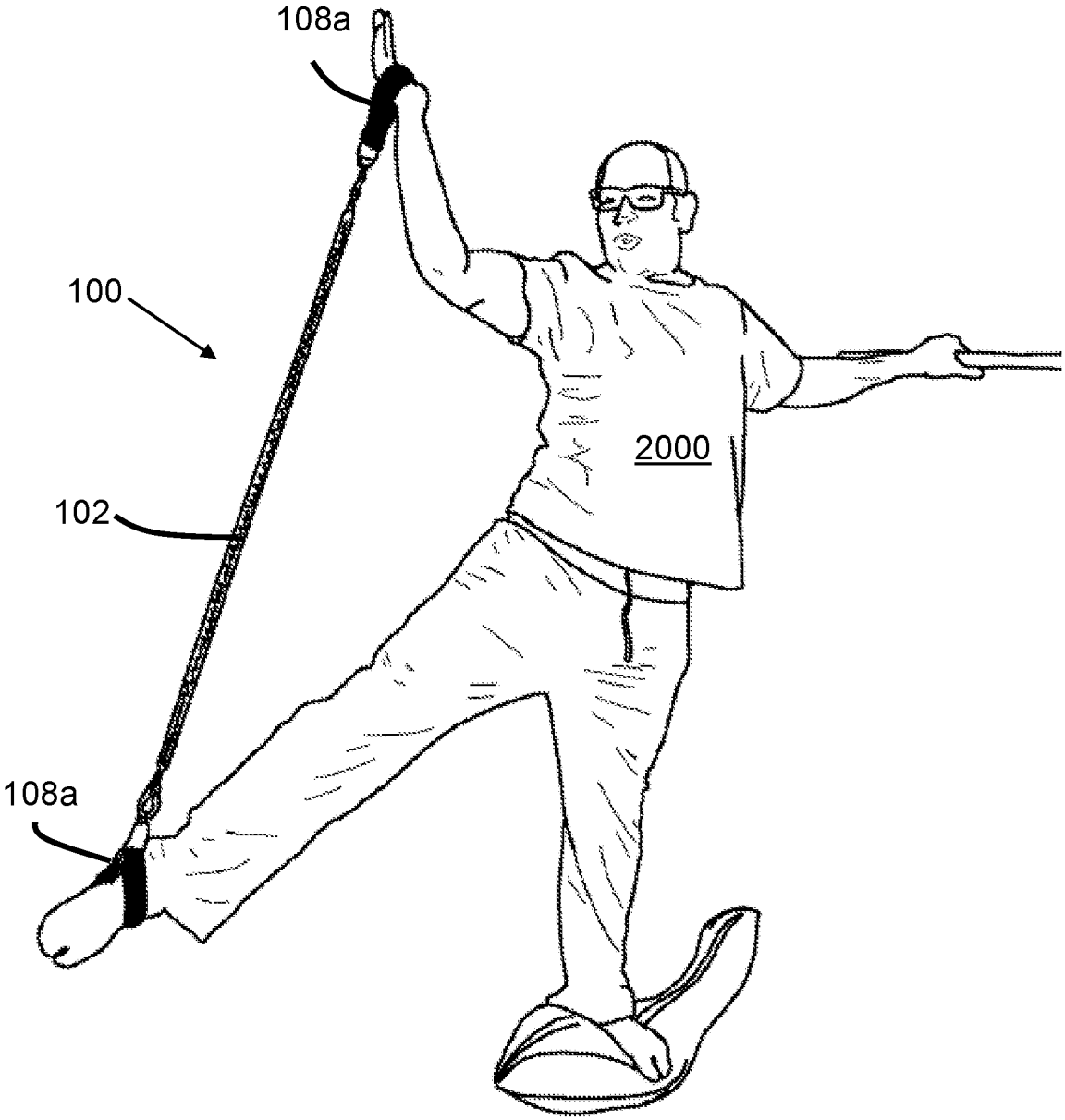
FIG. 20 illustrates a perspective view of a user exercising with the system, showing the user in the Standing Balance exercise on an engineered foam prop, in accordance with an embodiment of the present invention.
Figure 21:
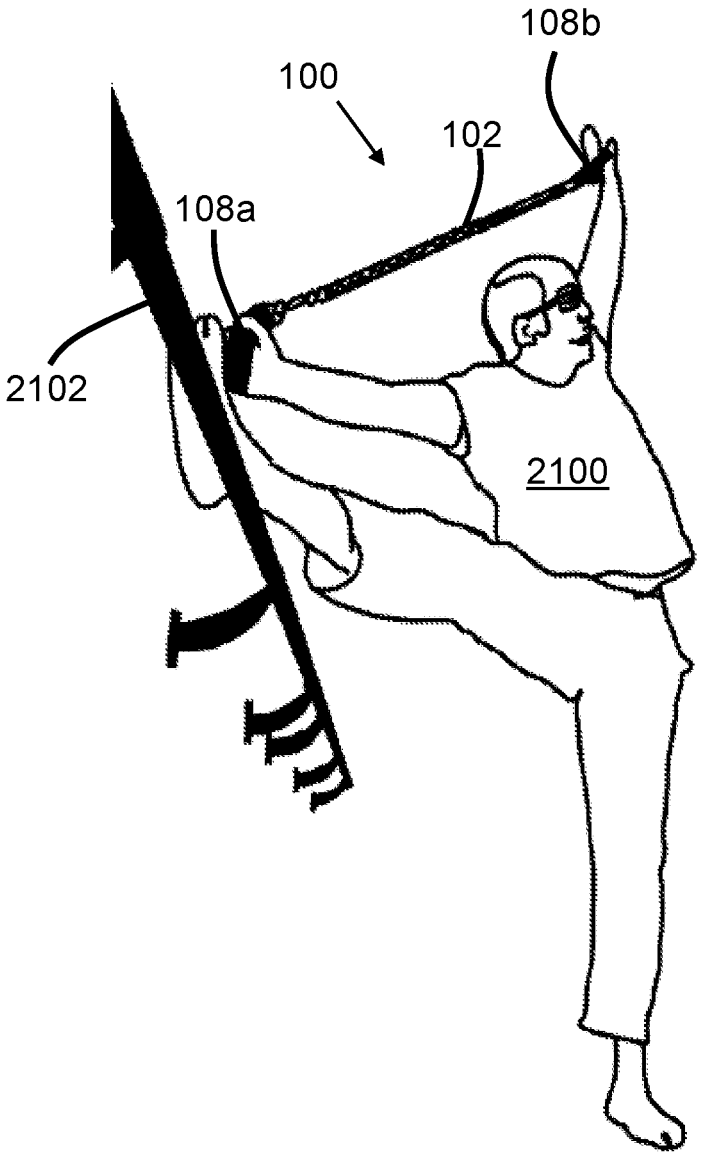
FIG. 21 illustrates a perspective view of a user exercising with the system, showing the user performing a Ballet exercise at a ballet barre, in accordance with an embodiment of the present invention.

Another exercise technique utilized by the method 3400 is shown in FIG. 19, which references the user in the Standing Yoga Reverse Triangle position 1900 with the user standing on the exercise mat while rotating the body as the spring stretches between the hands. FIG. 20 illustrates the user in a Standing Balance position 2000 with the left foot balancing on a support member, while the right foot and right hand stretch the spring to generate resistance, and thereby work the arm, leg, and core muscles. FIG. 21 shows the user in the Ballet position 2100 with the user resting a leg on a ballet bar 2102 while stretching the spring with the hands. This position serves to enhance balance and strengthen the deep stabilizers.

Figure 22A:
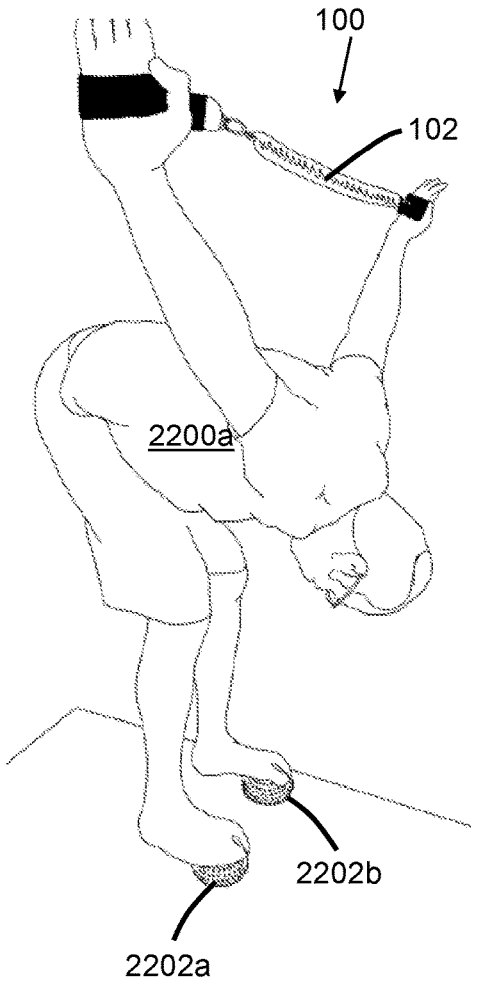
FIGS. 22A-22B illustrate perspective views of a user exercising with the system, showing the user standing on Foot Stretching Domes in the Eagle/Forward Fold position, and the Eagle/Forward Fold with Rotation position, in accordance with an embodiment of the present invention.
Figure 22B:
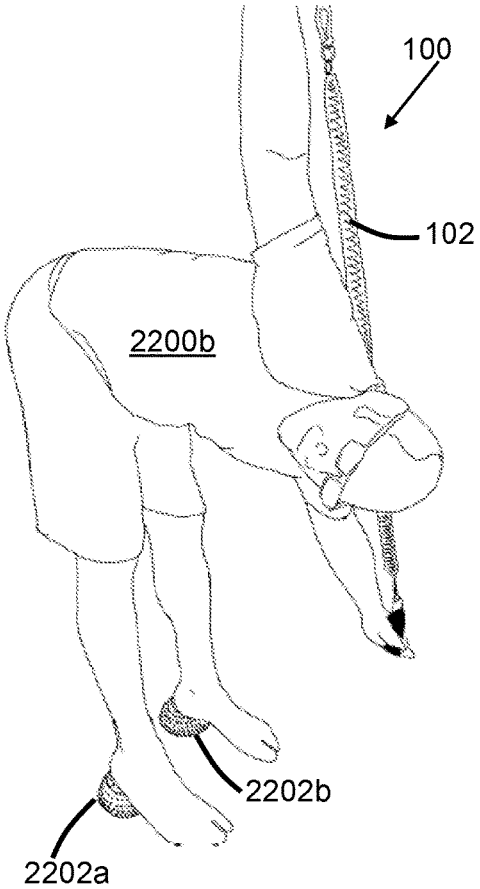
Figure 23:
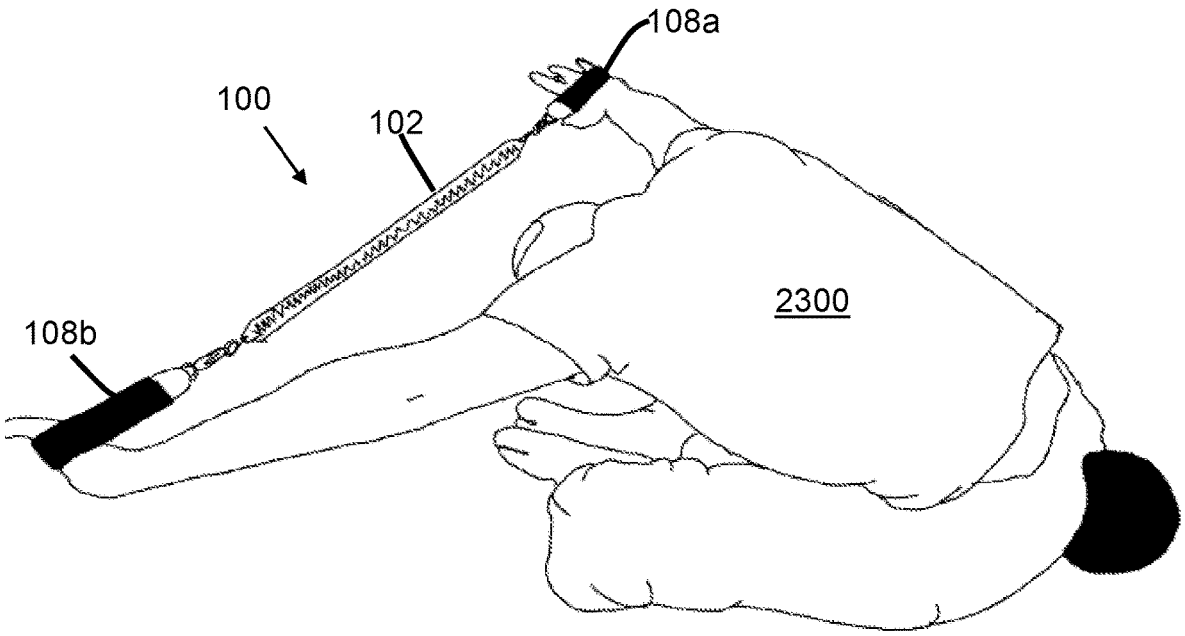
FIG. 23 illustrates a perspective view of a user exercising with the system, showing the user in seated forward fold/Eagle with an exercise ball at the top of the back, the leg/hamstring, in accordance with an embodiment of the present invention.
Figure 24:
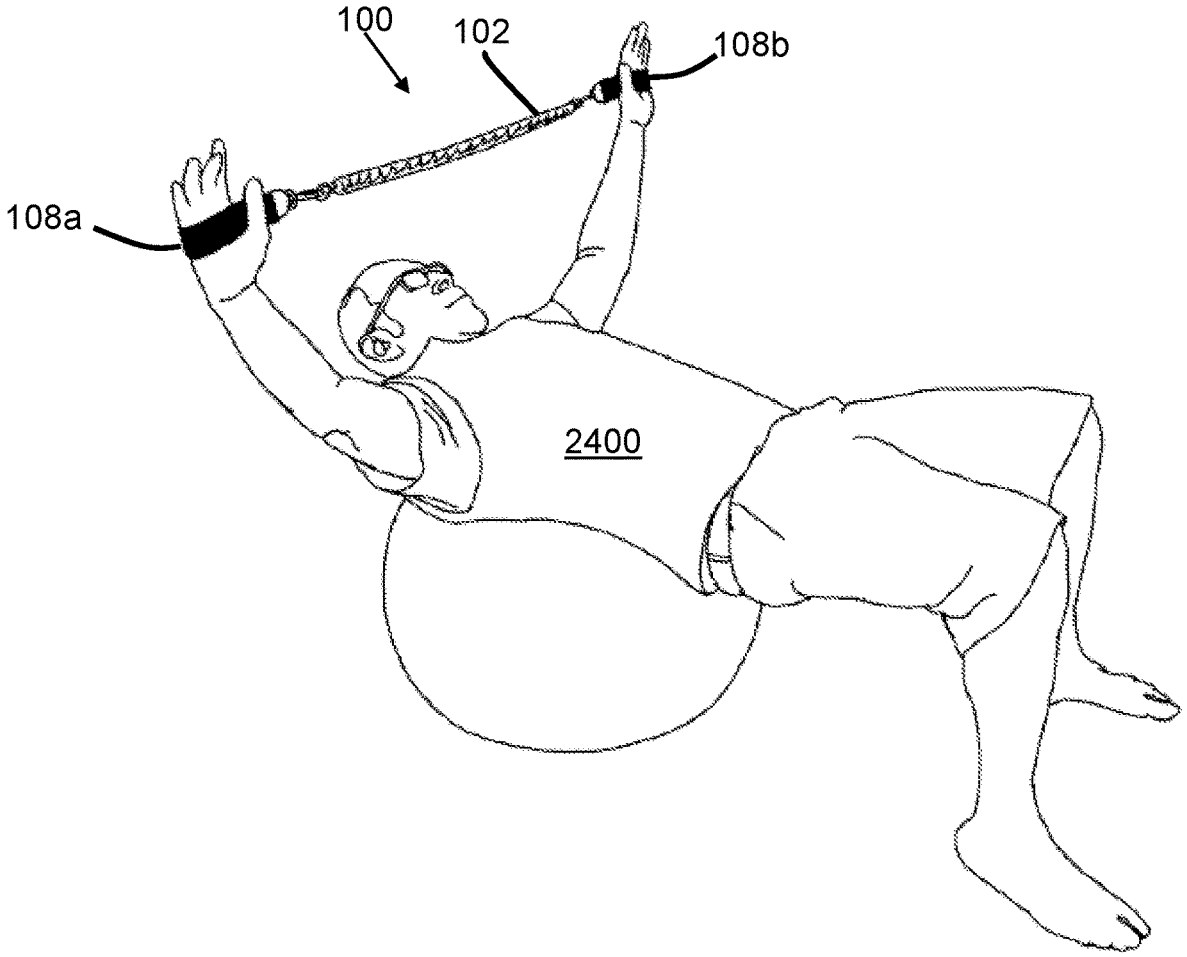
FIG. 24 illustrates a perspective view of a user exercising with the system, showing the user stretching the arms and performing abdominal exercises while lying on a Physio Ball, in accordance with an embodiment of the present invention.
Figure 25A:
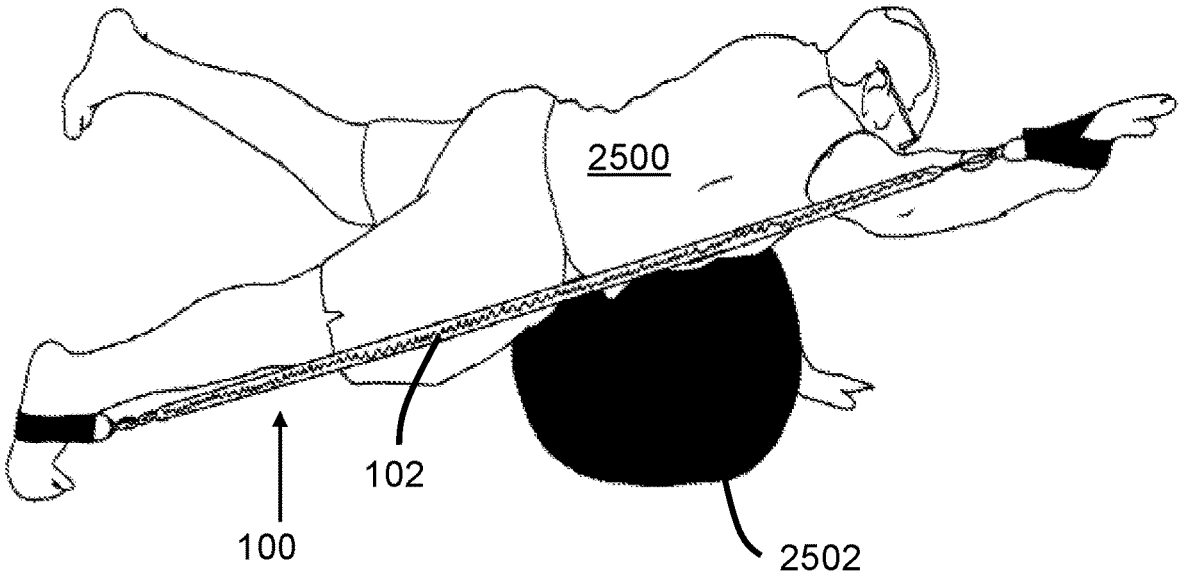
FIGS. 25A-25B illustrate perspective views of a user exercising with the system, showing the user lying prone across a Physio ball while stretching in pointer position, in accordance with an embodiment of the present invention.
Figure 25B:
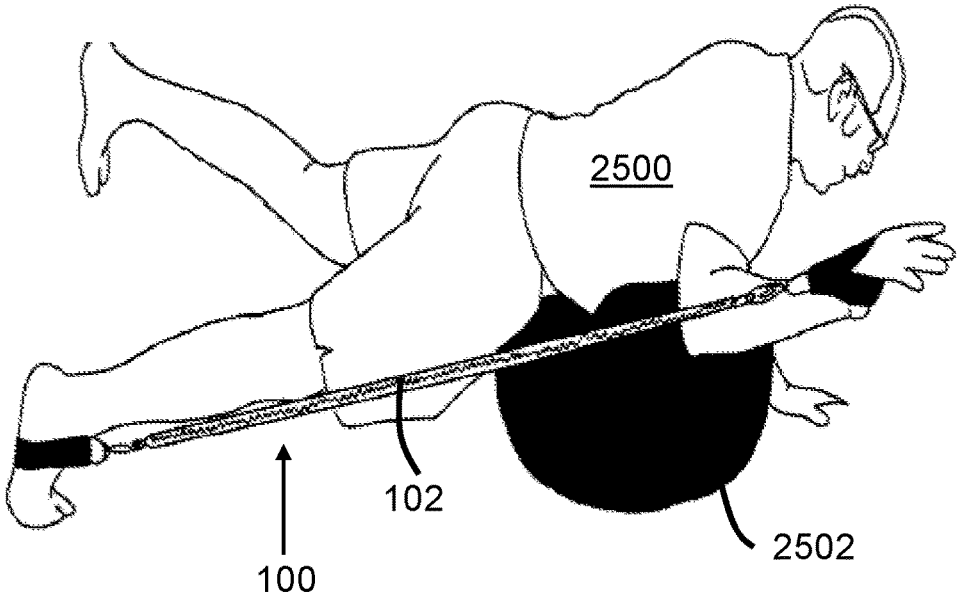

In yet another exercise technique, FIGS. 22A-22B illustrate the user standing on Foot Stretching Domes 2202*a*, 2202*b* in the Eagle exercise 2200*a* and the Rotated Eagle exercise 2200*b*, with the arms extended behind the back while simultaneously stretching the spring 102. This position serves to enhance balance and strengthen the back and leg muscles. FIG. 23 references the user sitting in the Eagle position 2300 with the user sitting with a ball under one leg to stretch the hamstring muscles and hips by leaning forward while stretching the spring between the hands. FIG. 24 illustrates a perspective view of the user stretching the arms while the back rests on a physio ball in a Press position 2400. Continuing with the exercise techniques, FIGS. 25A-25B reference the user exercising with the system, showing the user lying prone across a physio ball while stretching the spring from hand-to-foot 2500. This builds balance and arm muscle development in this bird dog exercise.

Figure 26:
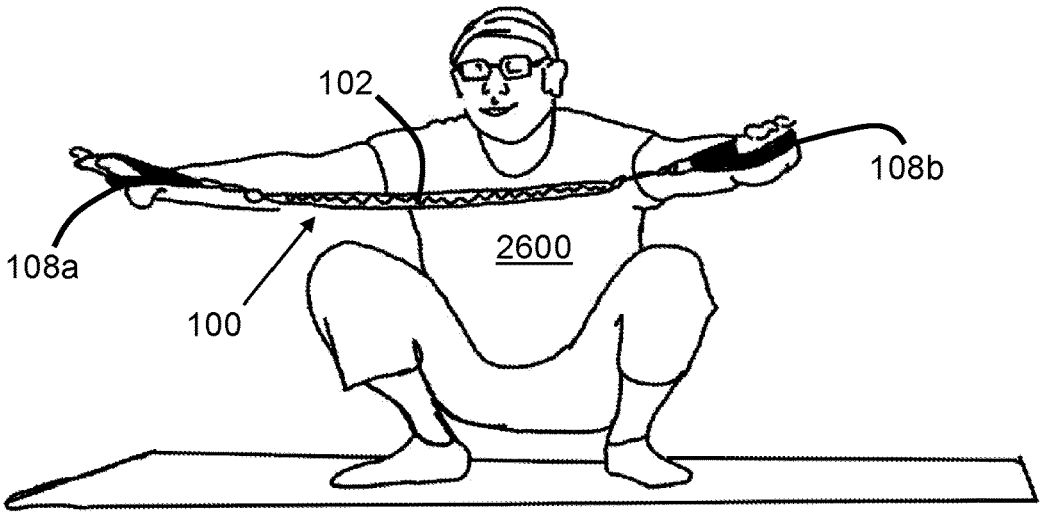
FIG. 26 illustrates a perspective view of a user exercising with the system, showing the user in a mat standing exercise in a Resistance Training Squat position, in accordance with an embodiment of the present invention.
Figure 27:
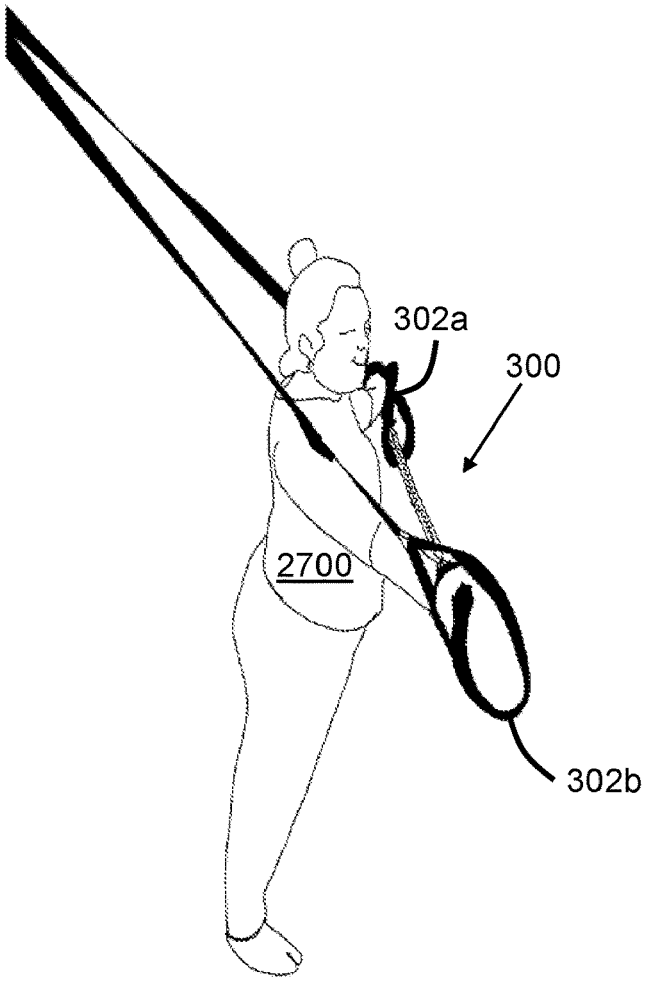
FIG. 27 illustrates a perspective view of a user exercising with the system, showing the user in a standing TRX Suspension position, in accordance with an embodiment of the present invention.
Figure 28:
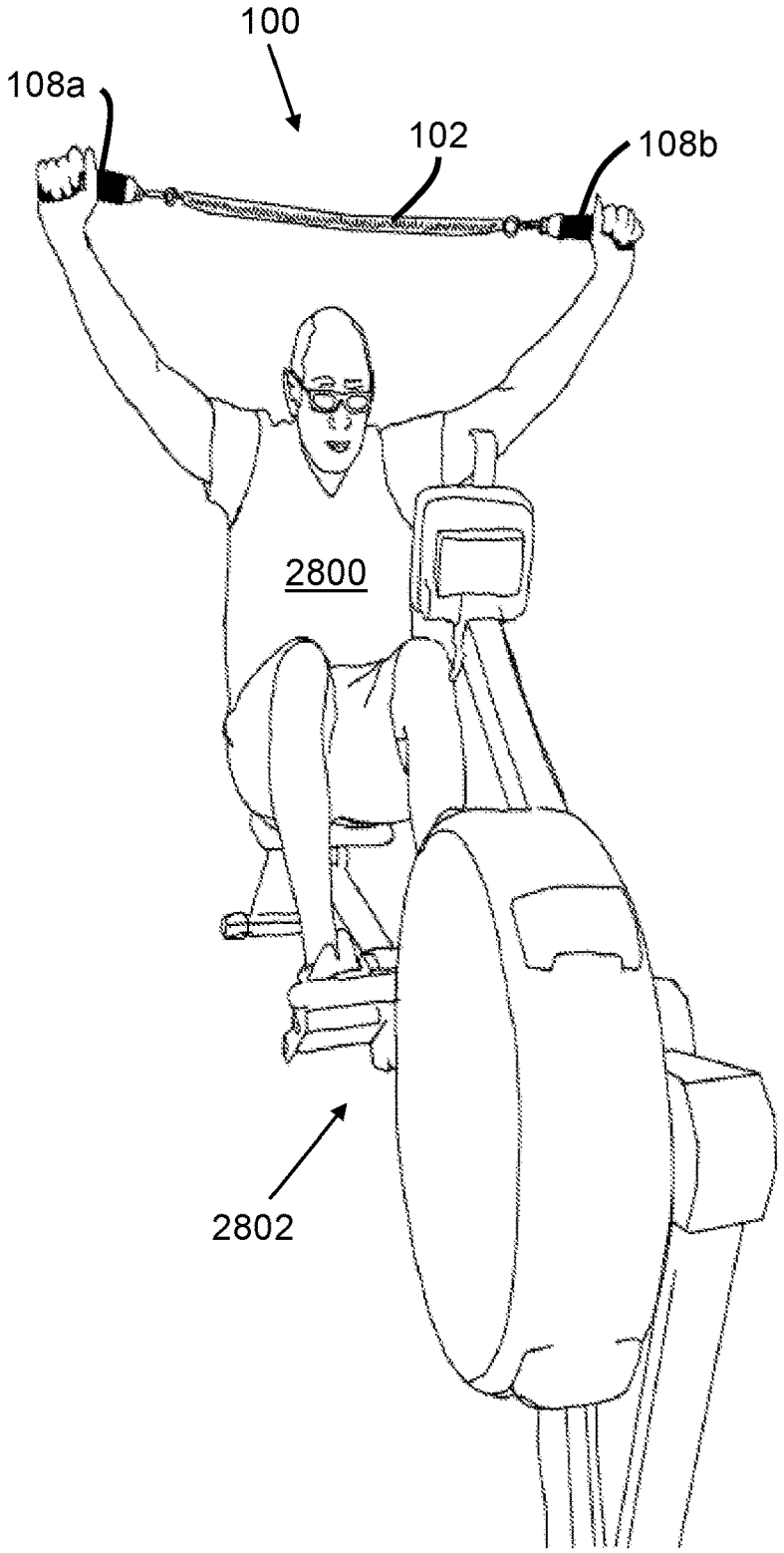
FIG. 28 illustrates a perspective view of a user exercising with the system, showing the user on a stationary recumbent exercise bicycle in a Salutation position, in accordance with an embodiment of the present invention.

Another exercise technique utilized by the method 3400 is shown in FIG. 26, which illustrates the user on an exercise mat in a Resistance Training Squat position 2600. FIG. 27 illustrates a perspective view of a user exercising with the system, showing the user in a TRX Suspension position 2700. The method 3400 also allows for use of an exercise bicycle 2802 while stretching the spring between the hands in seated Eagle. For example, FIG. 28 illustrates a perspective view of a user exercising with the system, showing the user on an exercise bicycle 2802 in a Rowing position 2800. The method 3400 also allows for use of a trampoline 2902 while stretching.

Figure 29:
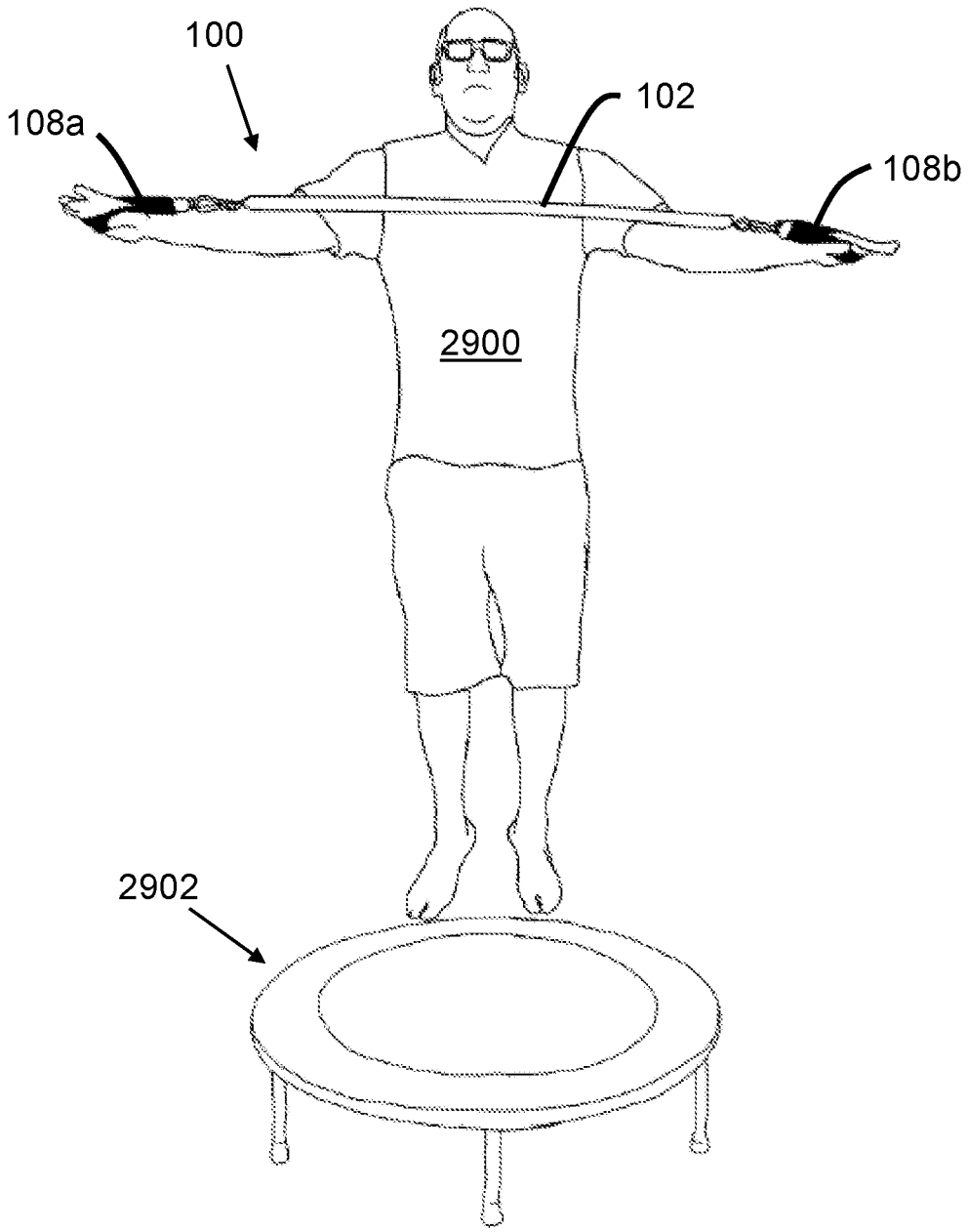
FIG. 29 illustrates a perspective view of a user exercising with the system, showing the user on a trampoline in a Stretch/Jump position, in accordance with an embodiment of the present invention.
Figure 30:
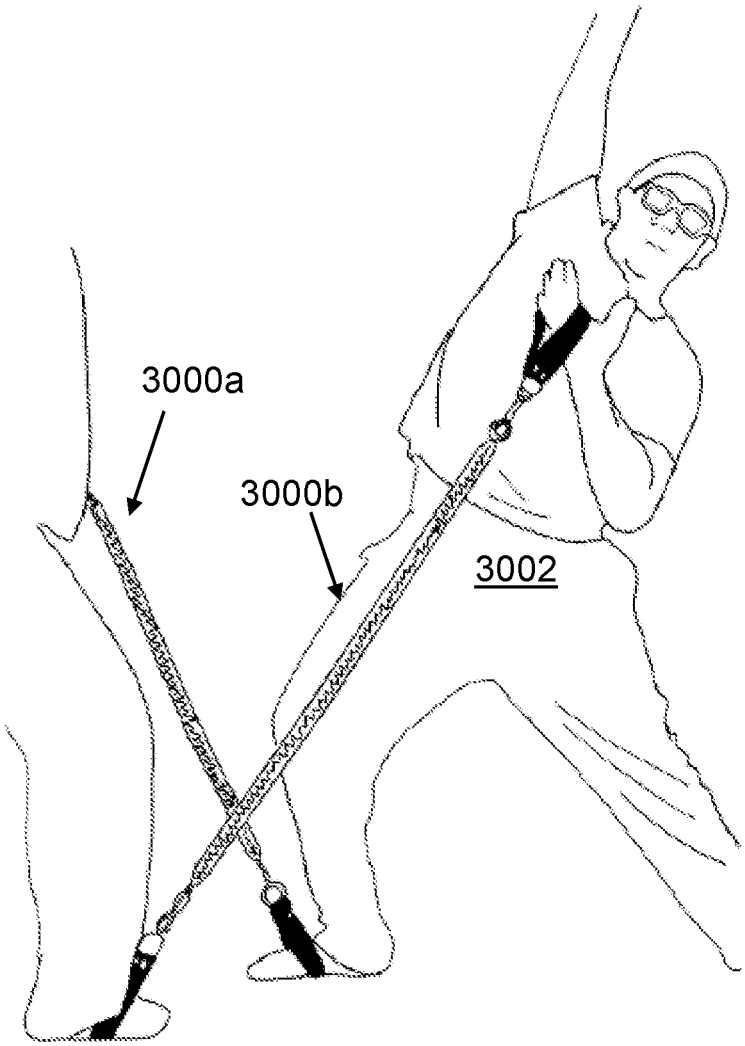
FIG. 30 illustrates a perspective view of a user exercising with the system, showing two users in a Standing Tandem position, in accordance with an embodiment of the present invention.

In yet another illustrative exercise routine, FIG. 29 illustrates the user jumping on a trampoline 2902 while stretching the spring between the hands in a Trampoline Stretch position 2900. FIG. 30 illustrates a perspective view of a user exercising with two systems 3000*a*, 3000*b*, showing two users in a Standing Tandem position 3002. This dual user capacity can be used with two or more systems, with each system having its own loop type and springs with different levels of resistance.

Figure 31:
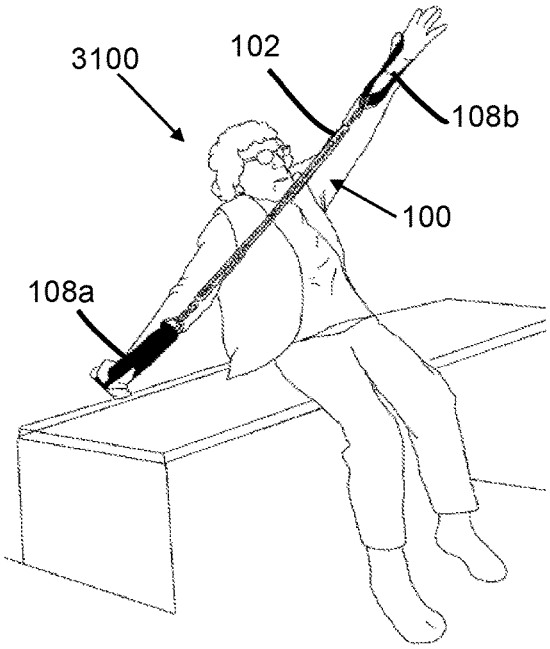
FIG. 31 illustrates a perspective view of a elderly user exercising with the system, showing the user in a cross chest Stretch position, in accordance with an embodiment of the present invention.
Figure 32:
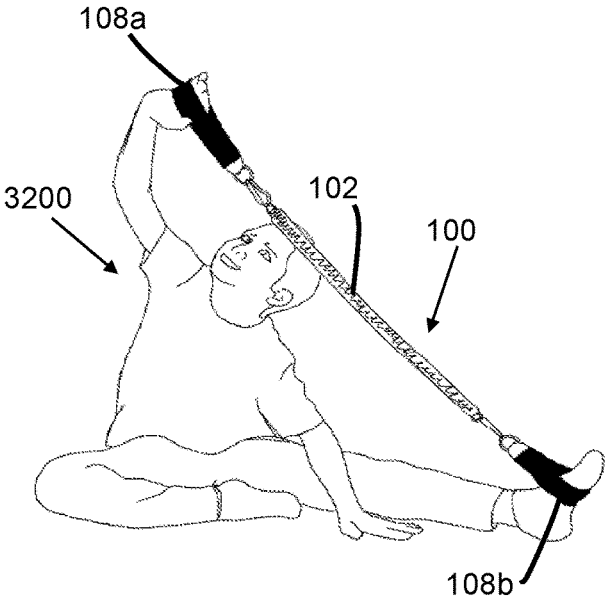
FIG. 32 illustrates a perspective view of a young/child user exercising with the system, showing the user in a hand-foot lateral Stretch position, in accordance with an embodiment of the present invention.
Figure 33:
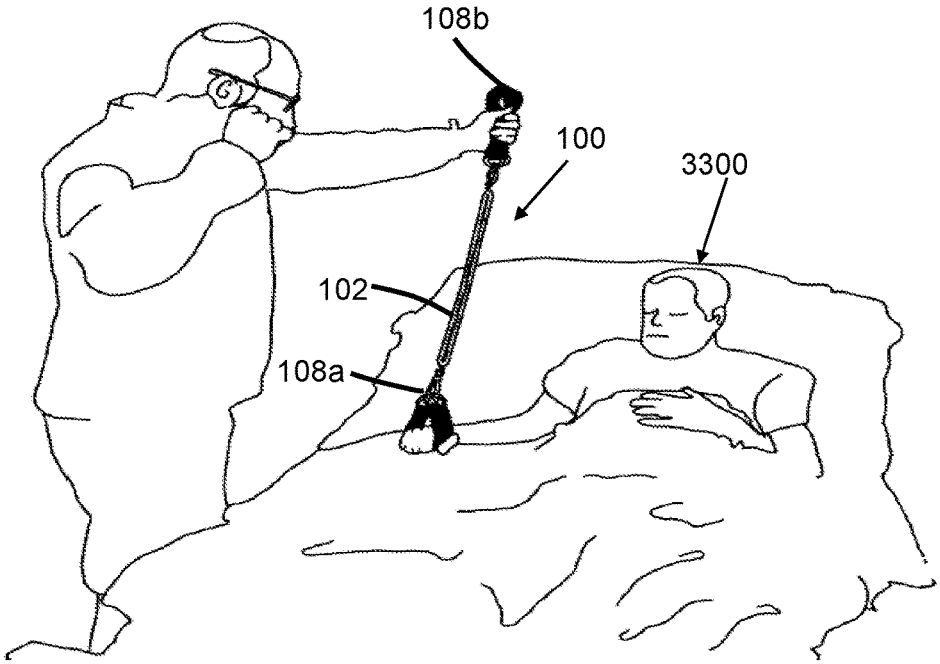
FIG. 33 illustrates a perspective view of a patient exercising with the system, showing the user in a Patient Tandem hand-to-hand position with practitioner for therapeutic exercise in hospital or other settings, in accordance with an embodiment of the present invention.

The exercise system 100 is also effective for enabling older and younger, and sick people to participate in Pilates exercise. For example, FIG. 31 illustrates a perspective view of an elderly user 3100 exercising with the system, showing the elderly user 3100 in a Stretch position. FIG. 32 illustrates a perspective view of a young user 3200 exercising with the system, showing the young user, such as a child, in a Stretch position. And FIG. 33 illustrates a perspective view of a patient 3300 exercising with a partner as each person grabs one end of the spring and stretches in a Patient Tandem position. Thus, the capacity to change loops and levels of spring resistance allow the elderly, young children, and sick people can also benefit from the system 100, 200, 300.

Figure 35:
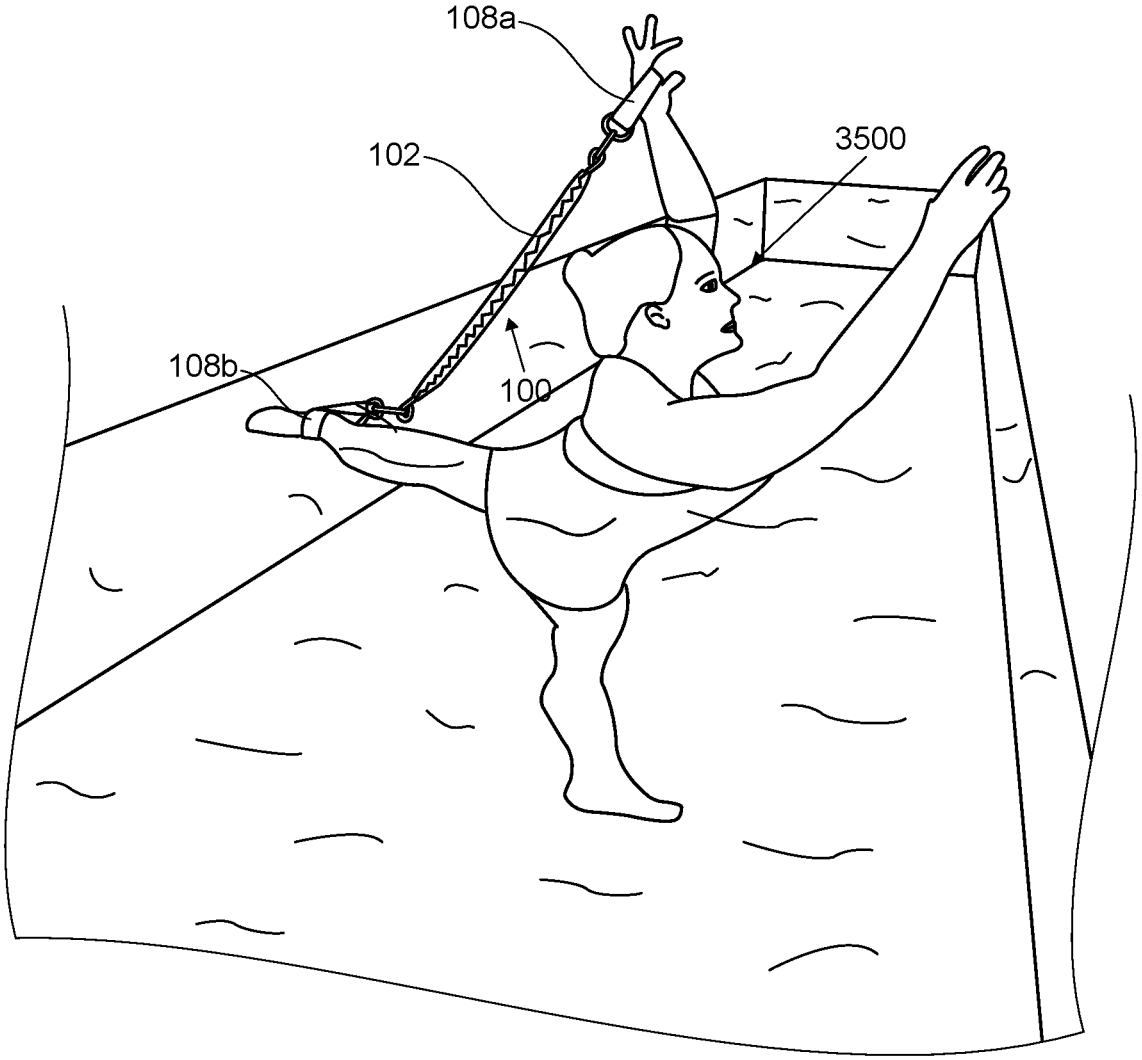
FIGS. 35 & 36 respectively illustrate a perspective view of a user exercising with the system in the pool, showing the user in a standing Stretch position 1 & 2 both with a free hand and a hand on pool edge to form variations of standing balance, in accordance with an embodiment and example of the versatility of the present invention.
Figure 36:
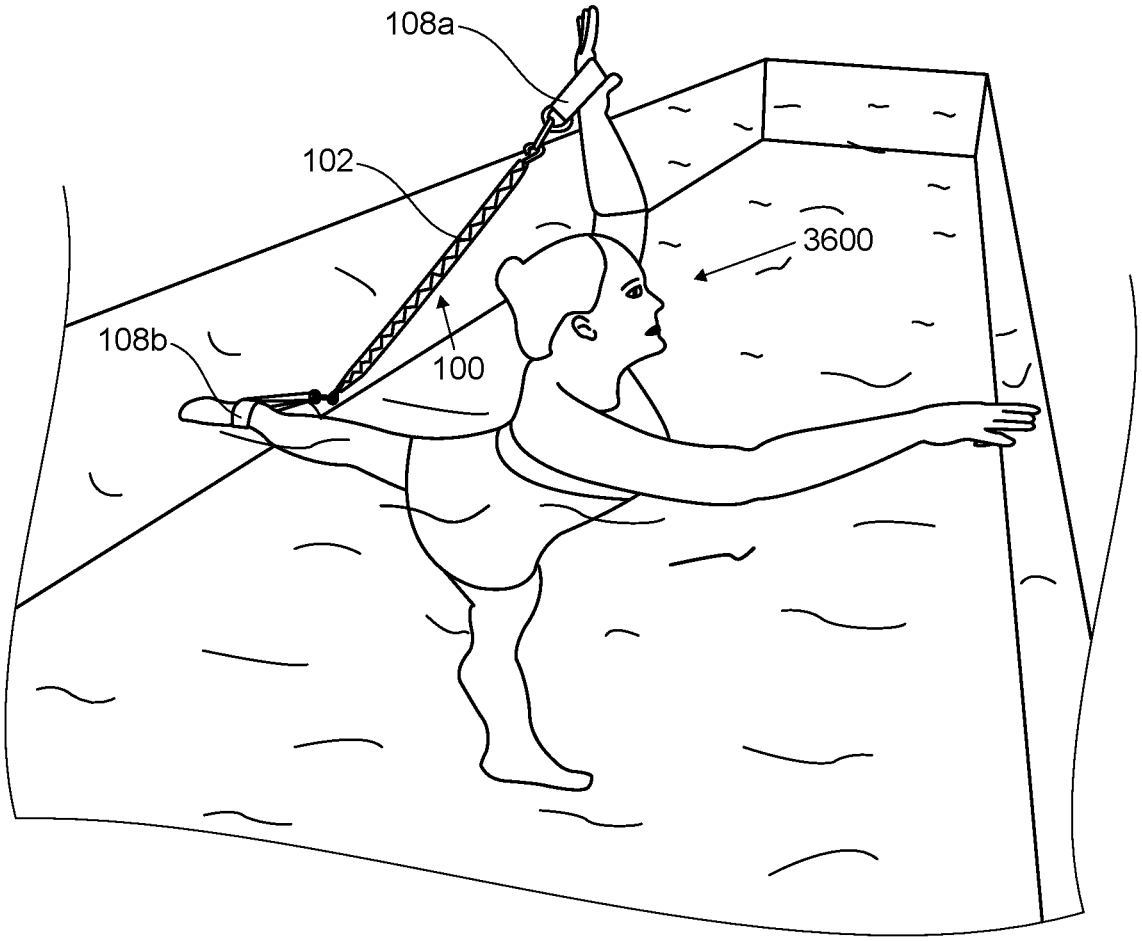

The exercise system 100 can be also effective for using in the swimming pool for user to have an additional option when he or she goes to the pool, or for the person who needs to do rehabilitation in the water. For example, FIG. 35 illustrates a perspective view of a user 3500 exercising with the system, showing the user 3500 in a Stretch position 1. And, FIG. 36 illustrates another perspective view of a user 3600 exercising with the system, showing the user 3600 in a different Stretch position 2. Thus, the capacity to change loops and levels of spring resistance allow the user in the pool can also benefit from the system 100, 200, 300.

Figure 37:
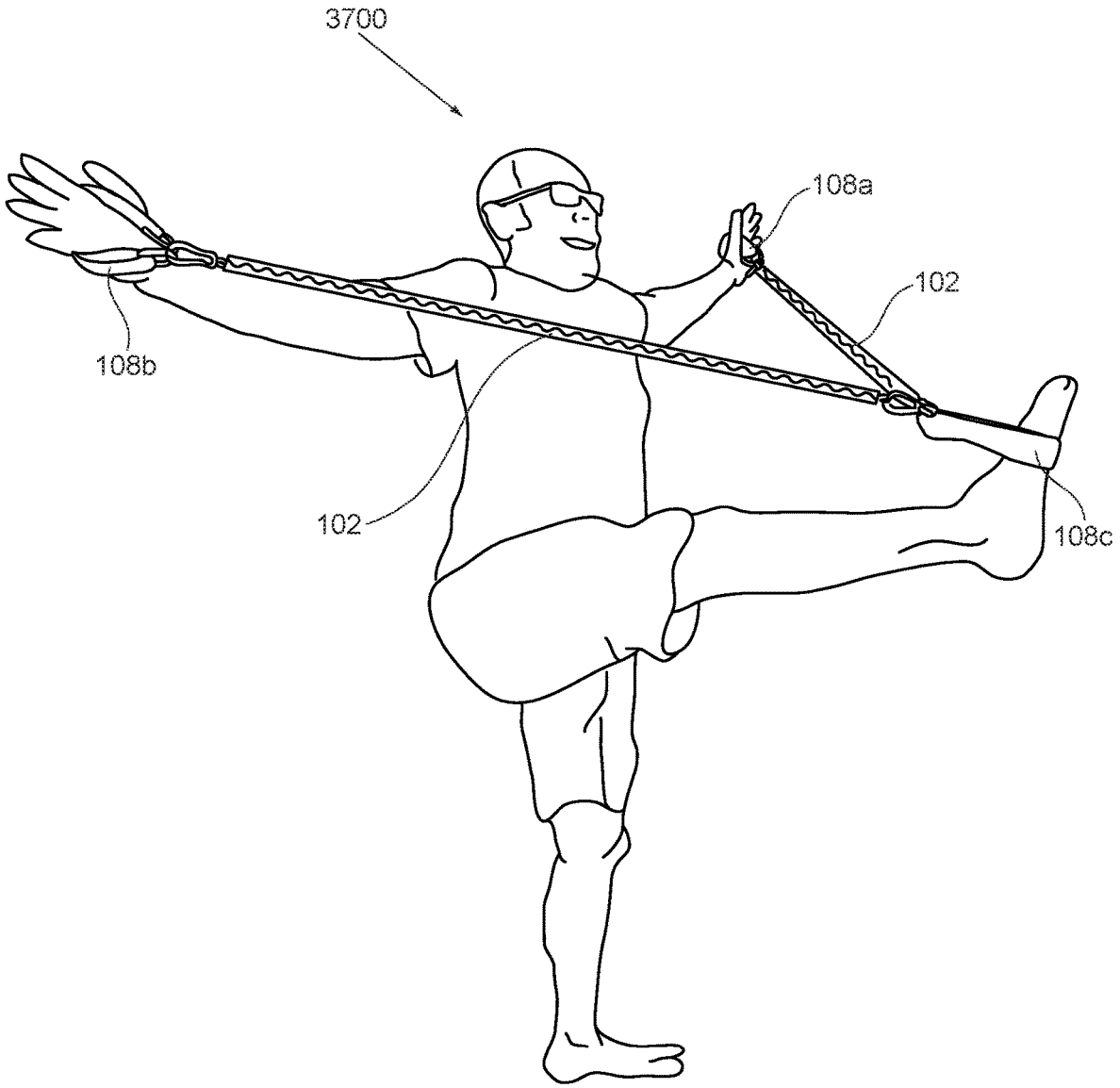
FIG. 37 illustrates a perspective view of a patient exercising with the system for stretching legs and arms, while the system having two springs with three loops, in accordance with an embodiment and example of the versatility of the present invention.

In other embodiments, the exercise system 100 are employing two springs 102 with three loops (graspable handles) 108*a-c*. For example, FIG. 37 illustrates a perspective view of a user 3700 exercising with the system, showing the user 3700 in a Stretch position to stretch legs and arms, while the system having two springs 102 with three loops 108*a-c*.

Figure 38:
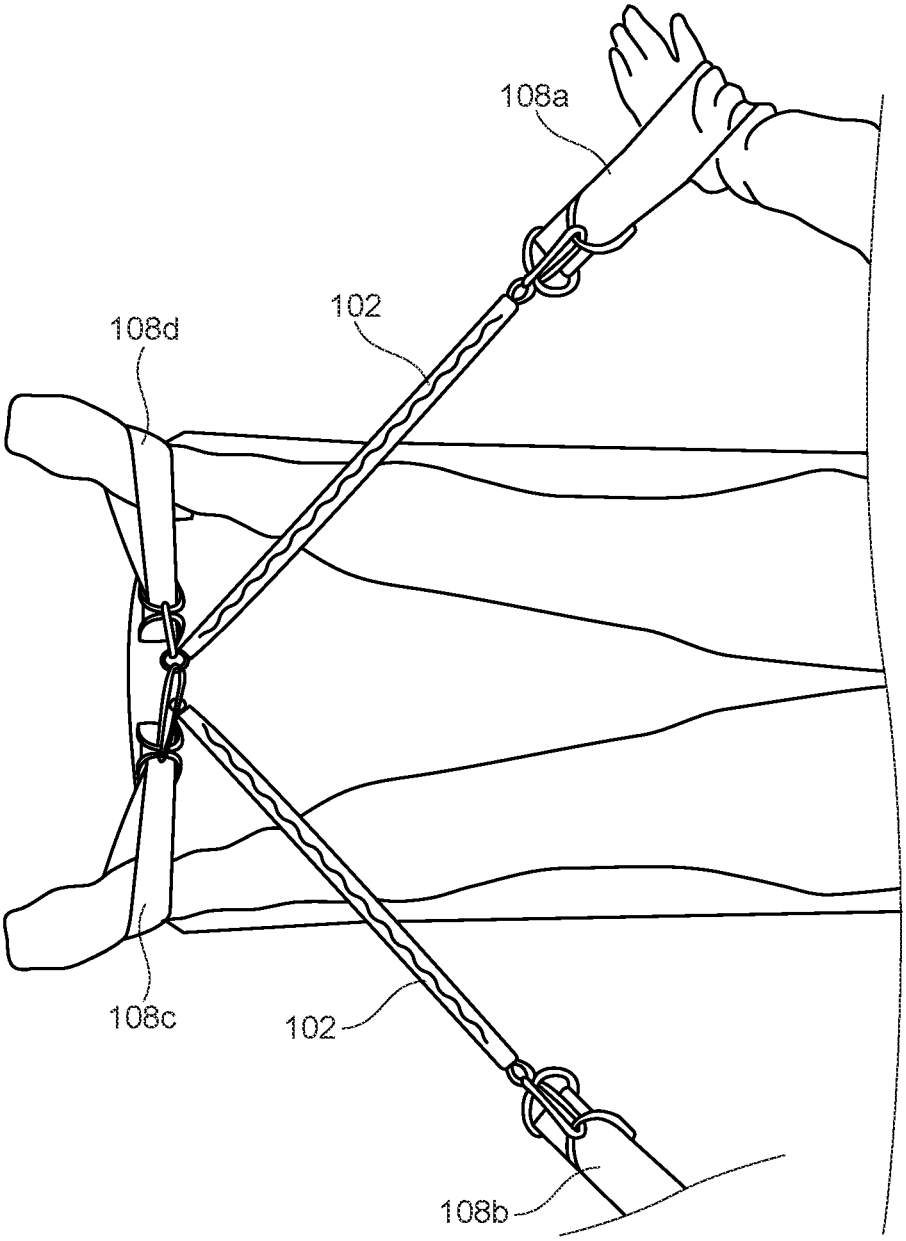
FIGS. 38 & 39 respectively illustrate a perspective view of a user exercising with the system in a different stretch position, while the system having two springs with four loops, in accordance with an embodiment and example of the versatility of the present invention.

In other embodiments, the exercise system 100 are employing two springs 102 with four loops (graspable handles) 108*a-d*. For example, FIG. 38 illustrates a perspective view of a user exercising with the system, showing the user in a Stretch position 1 to stretch legs and arms, while the system having two springs 102 with four loops 108*a-d*. And, FIG. 39 illustrates another perspective view of a user 3900 exercising with the system, showing the user 3900 in a different Stretch position 2 to stretch legs and arms, while the system having two springs 102 with four loops 108*a-d*.

Figure 39:
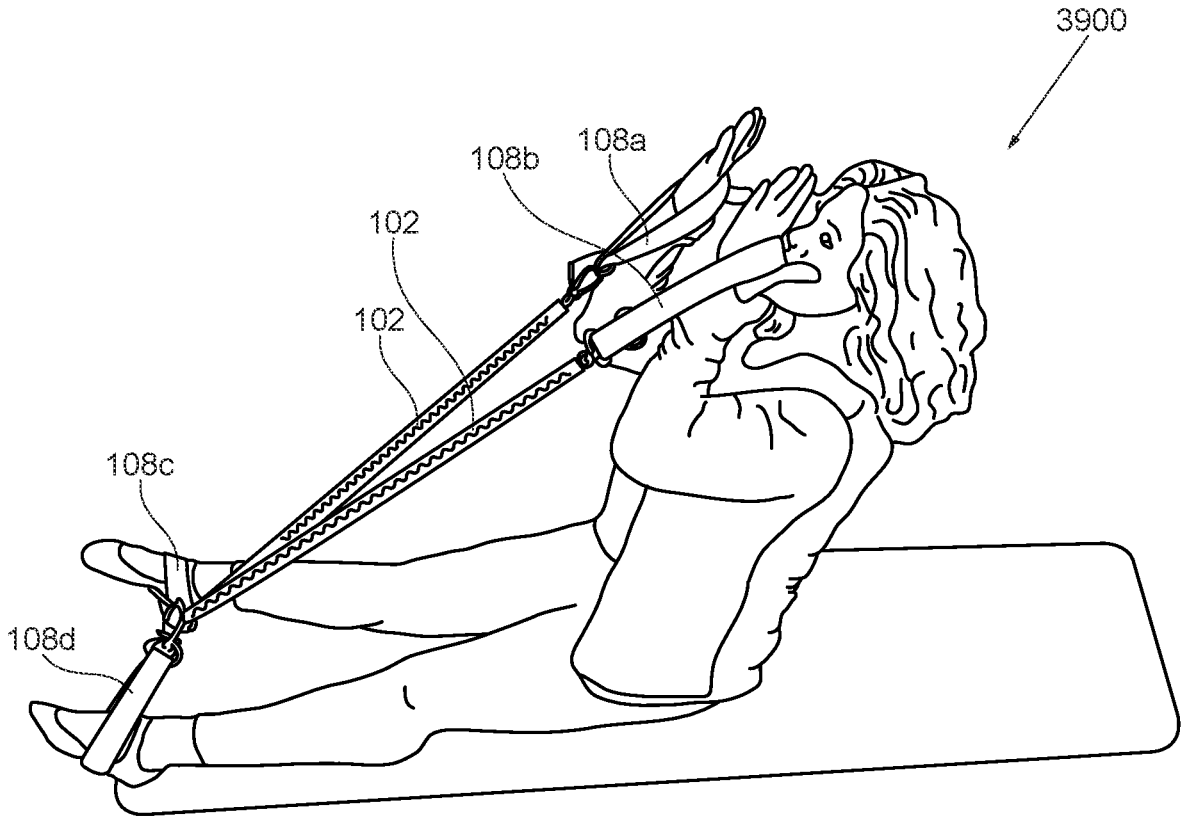
Figure 40:
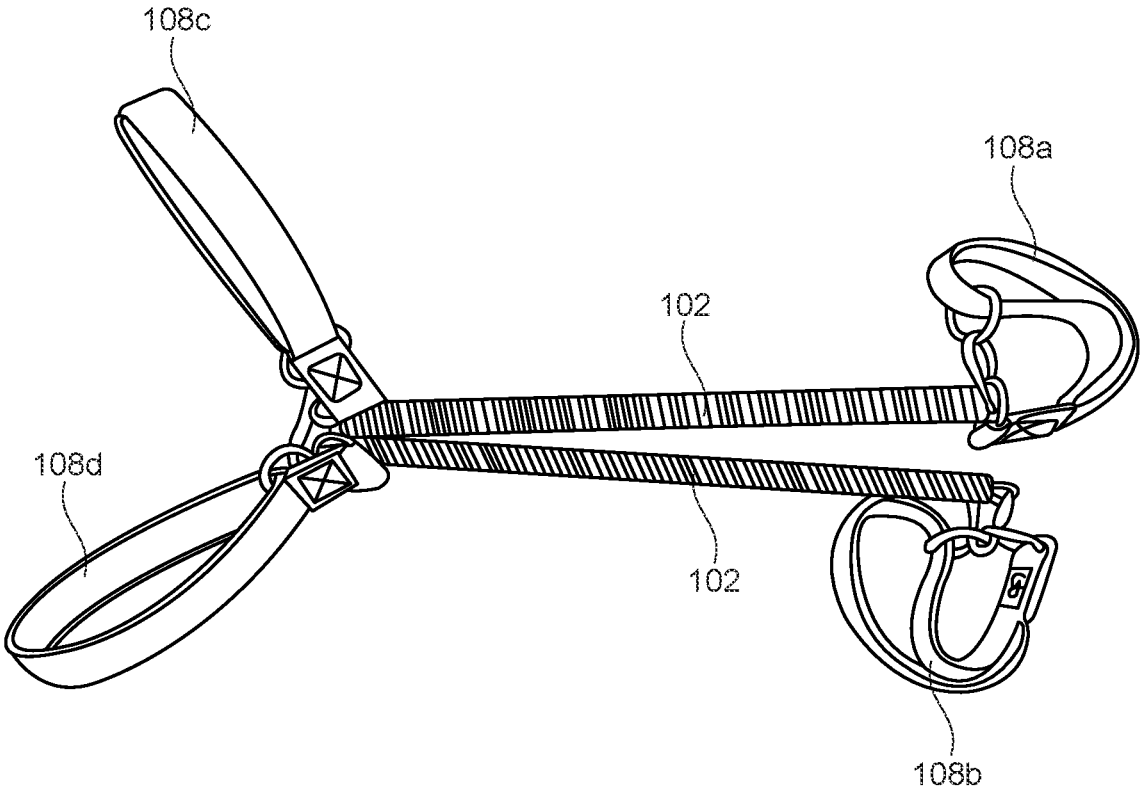
FIGS. 40 & 41 respectively illustrate a perspective view of another embodiment of Spring exercise system, showing employing two springs with four loops, in accordance with an embodiment of the present invention, in accordance with an embodiment and example of the versatility of the present invention.
Figure 41:
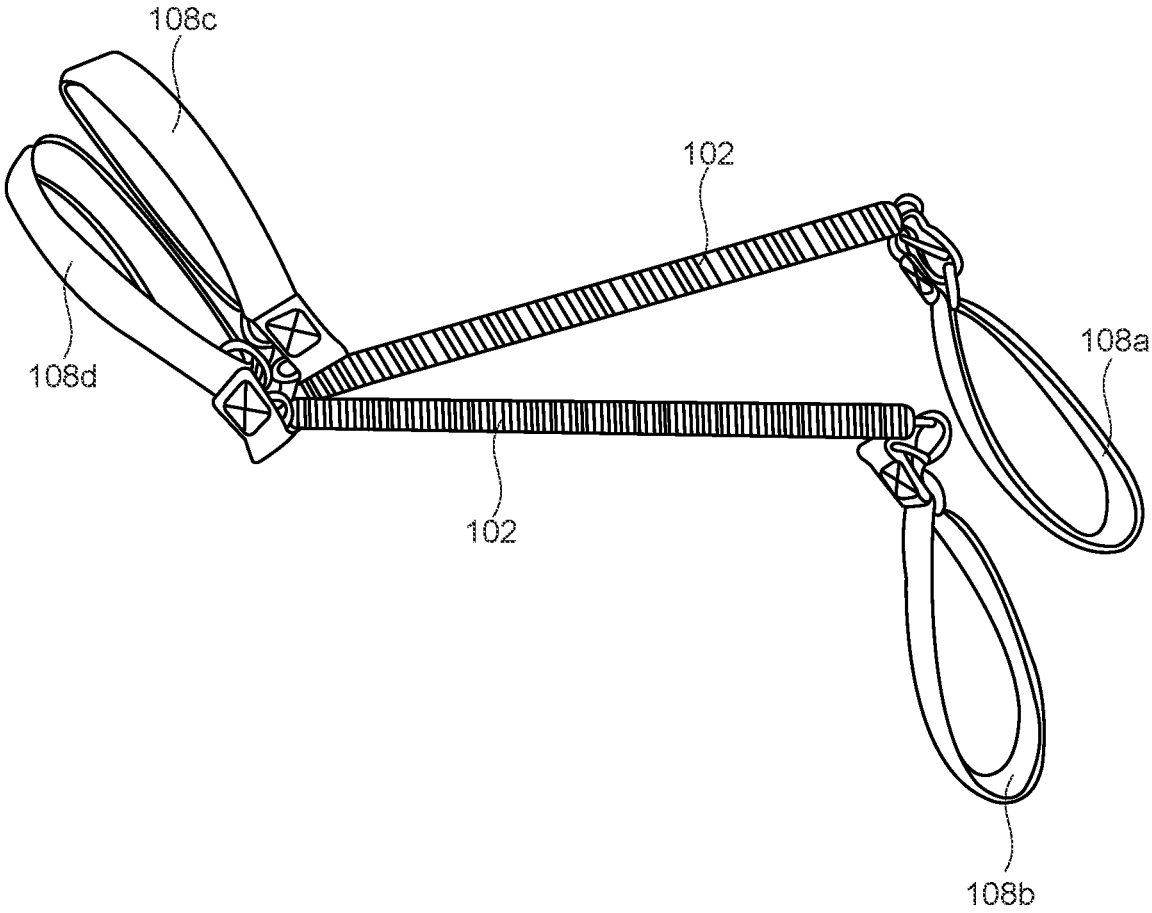

Furthermore, the FIGS. 40& 41 respectively illustrate a perspective view of Spring exercise system, like used in the FIGS. 38 & 39, the Spring exercise system employed with four loops 108*a-d* and two springs 102 to create bilateral exercise options with this apparatus, using two hands or two feet alternatively with one foot or one hand. There are multiple standing and combined with other exercise apparatus that are not pictured here, but are consistent with other illustrations herein and with the Method employed throughout with the single spring apparatus.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A spring exercise system, comprising:

a spring defined by a pair of free ends, the spring operable to generate resistance to a pulling or pressing force when stretched;

a pair of grasp handles respectively attached to the pair of free ends of the spring, the pair of grasp handles being operable to enable grasping to hands, feet, or both of a user; and a pair of swiveling connectors respectively joining the pair of free ends of the spring to the pair of grasp handles, the pair of swiveling connectors respectively enabling the pair of grasp handles to rotate up to 360 degrees;

whereby the resistance generated by the spring generates an extension of resistance;

wherein the pair of grasp handles are each resilient double loop handles;

wherein each resilient double loop handle comprises an inner loop and an outer loop, the inner loop being operable to enable grasping by the hand, the outer loop being operable to enable wrapping around a wrist of the user; and wherein for each of the pair of grasp handles, a corresponding one of the pair of swiveling connectors connects the inner loop and the outer loop to a corresponding one of the pair of free ends of the spring to enable the inner loop and the outer loop to move independently.

2. The spring exercise system of claim 1, wherein the spring is an extension spring.

3. The spring exercise system of claim 2, wherein the extension spring is a non-fixed spring.

4. The spring exercise system of claim 1, wherein the spring is defined by a hard resistance.

5. The spring exercise system of claim 1, wherein the spring is defined by a medium resistance.

6. The spring exercise system of claim 1, wherein the spring is defined by a soft resistance.

7. The spring exercise system of claim 1, wherein the spring comprises a metal material.

8. The spring exercise system of claim 1, wherein the outer loop of each resilient double loop handle has a greater resilience than that of the respective inner.

9. The spring exercise system of claim 1, wherein the pair of grasp handles include at least one of the following materials: leather, fleece, neoprene, and cloth.

10. The spring exercise system of claim 1, wherein the spring exercise system is operable to perform Pilates-styled exercises.

11. The spring exercise system of claim 1, wherein the pair of grasp handles are configured to be grasped by the hands, or abutted against the feet, or both.

12. A spring exercise system, comprising:

an extension spring defined by a pair of free ends, the extension spring operable to generate resistance to a pulling or pressing force when stretched;

a pair of grasp handles respectively attached to the pair of free ends of the extension spring, the pair of grasp handles being operable to enable grasping to hands, feet, or both of a user; wherein the pair of grasp handles are each resilient double loop handles;

wherein each resilient double loop handle comprises an inner loop and an outer loop, the inner loop being operable to enable grasping by the hand, the outer loop being operable to enable wrapping around a wrist of the user, the outer loop of each resilient double loop handle having a greater resilience than that of the respective inner loop; and a pair of swiveling metal chain links respectively joining the pair of free ends of the extension spring to the pair of grasp handles, the pair of swiveling metal chain links respectively enabling the pair of grasp handles to rotate up to 360 degrees, whereby the resistance generated by the extension spring generates an extension of resistance;

wherein for each of the pair of grasp handles, a corresponding one of the pair of swiveling metal chain links connects the inner loop and the outer loop to a corresponding one of the pair of free ends of the extension spring to enable the inner loop and the outer loop to move independently.

13. The spring exercise system of claim 12, wherein the extension spring is defined by one of: a hard resistance, a medium resistance, and a soft resistance.

14. The spring exercise system of claim 12, wherein the pair of grasp handles are configured to be grasped by the hands, or abutted against the feet, or both.

15. A spring exercise method, comprising:

grasping, with a hand, a first grasp handle attached to one end of an extension spring;

abutting, with a foot, a second grasp handle attached to an opposing end of the extension spring;

extending an arm comprising the hand against a tension of the extension spring;

extending a leg comprising the foot against the tension of the extension spring;

causing the extension spring to stretch, whereby an extension of resistance is generated;

retracting the arm and the leg simultaneously; and repeating multiple extensions and retractions of the arm and leg, whereby a low-impact exercise is performed;

wherein the first and second grasp handles are resilient double loop handles each comprising an inner loop and an outer loop;

wherein for each of the first and second grasp handles, a corresponding one of a pair of swiveling connectors connects the inner loop and the outer loop to a corresponding one of the one end and the opposing end of the extension spring to enable the inner loop and the outer loop to move independently.

* * * * *